US006499817B2

(12) United States Patent
Jermain

(10) Patent No.: US 6,499,817 B2
(45) Date of Patent: Dec. 31, 2002

(54) LOCKER

(75) Inventor: Richard B. Jermain, Kennedy, NY (US)

(73) Assignee: American Locker Group Incorporated, Jamestown, NY (US)

( * ) Notice: Subject to any disclaimer, the term of this patent is extended or adjusted under 35 U.S.C. 154(b) by 0 days.

(21) Appl. No.: 09/406,590

(22) Filed: Sep. 27, 1999

(65) Prior Publication Data

US 2001/0043030 A1 Nov. 22, 2001

(51) Int. Cl.[7] ..... A47B 47/00
(52) U.S. Cl. ..... 312/257.1; 312/265.5
(58) Field of Search ..... 312/108, 199, 312/257.1, 263, 265.5, 271

(56) References Cited

U.S. PATENT DOCUMENTS 335,014 A * 1/1886 Campbell ..... 312/265.5 X
687,740 A * 12/1901 French ..... 312/108 X
726,555 A * 4/1903 Mayer ..... 312/108 X
881,673 A * 3/1908 Ellison ..... 312/263 X
1,046,488 A * 12/1912 Pauley ..... 312/257.1 X
1,268,509 A * 6/1918 Stone ..... 312/263 X
1,448,235 A * 3/1923 Read ..... 312/263 X
5,372,415 A * 12/1994 Tisbo et al. ..... 312/108
6,113,203 A * 9/2000 Chen ..... 312/257.1 X
6,332,657 B1 * 12/2001 Fischer ..... 312/257.1 X

* cited by examiner

*Primary Examiner*—Peter M. Cuomo
*Assistant Examiner*—Michael J. Fisher
(74) *Attorney, Agent, or Firm*—Kirkpatrick & Lockhart LLP

(57) ABSTRACT

A locker. The locker comprises a first side wall having an interlocking portion, a second side wall having a first interlocking portion engaging the interlocking portion of the first side wall and a second interlocking portion, and a third side wall having an interlocking portion engaging the second interlocking portion of the second side wall. A coin receptacle, coin receptacle locking mechanism, a shelf and a door for the locker are also disclosed. A method of manufacturing a locker is also provided. The method comprises cutting a first wall from a first material to a desired length, cutting a second wall from the first material to the desired length, cutting a third wall to the desired length, and slidingly engaging the first, second and third walls. A method for limiting access to a locking mechanism is also provided, which comprises positioning the locking mechanism adjacent an inward facing surface and fastening the locking mechanism to the locker.

11 Claims, 41 Drawing Sheets

LOCKER

CROSS-REFERENCE TO RELATED APPLICATIONS

Not Applicable.

FEDERALLY SPONSORED RESEARCH

Not Applicable.

BACKGROUND OF THE INVENTION

1. Field of the Invention

The present invention relates to lockers and, more particularly, to weather resistant coin operated lockers.

2. Description of the Invention Background

A variety of different methods and apparatuses have been developed for securing personal possessions in public areas. One apparatus that has been developed is a coin operated locker for storage of personal possessions. Such a locker commonly includes two vertical parallel side panels, a vertical rear panel attached to both side panels, a top and a bottom, thereby creating a storage compartment enclosed on five sides. The front of the locker typically has at least one lockable door. A front-mounted coin operated locking mechanism and a coin receptacle located beneath the locking mechanism in a channel are also common components of such lockers. The walls and door of lockers are typically fabricated from flat rolled steel, welded by a skilled mechanic, and arranged along horizontal and vertical planes. The locking mechanism in a typical application maintains the door in an unlocked condition until a coin is inserted therein. Once a coin is inserted into the locking mechanism, a key in the locking mechanism may be rotated to lock the door and then the key may be removed. The key must then be reinserted in the locking mechanism to unlock the door. When placed in the unlocked position, the key of the typical locking mechanism may not be removed unless another coin is inserted. The coin receptacle is typically situated alongside the storage compartment or beneath the storage compartment. Coins that are inserted into the locking mechanism are directed into the coin receptacle where they accumulate until they are periodically removed. Such lockers are commonly found grouped together to provided many separate storage compartments for use by a number of people. Such lockers, however, are not suitable for outdoor use because their steel construction deteriorates rapidly in such conditions. Such steel lockers are, furthermore, disadvantageously heavy and expensive to fabricate. Front-mounted locking mechanisms are disadvantageous because they may be vandalized by prying. In addition, a channel-mounted coin receptacle is disadvantageously small and, thus, will overflow unless emptied regularly. The time and skill required to weld a locker together is another disadvantage of a conventional locker.

Another common problem with known lockers is that they often become soiled by way of spills that occur therein, by foods that melt and stick to the compartment or by other means. Such soiling often prevents a locker from being reused until the soiling has been discovered and removed because items placed in a soiled locker may in turn be soiled. Known lockers are also disadvantageously difficult to clean. Pressurized water generally may not be directed into previous steel structures because of the potential for rusting of the structure, particularly in areas that cannot be easily dried. In addition, previous structures having a flat lower surface or shelf tend to retain spilled material and other impurities thereon. Furthermore, when a flat shelf becomes soiled, other items placed on that soiled shelf are likely to become soiled themselves, thereby placing the soiled locker, for all practical purposes, unusable until the impurities are discovered and removed.

Therefore, there is a particular need for a locker that is suitable for outdoor use. There is also a need for a locker having a locking mechanism that is not susceptible to prying. There is, furthermore, a need for a locker that has a large coin receptacle that is not prone to overflowing. There is also a particular need for a locker that prevents spilled material and other forms of impurities in the locker from contacting personal possessions later placed in the locker. There is also a need for a locker that may be easily cleaned by directing pressurized water from a hose or other device into the locker storage compartment. There is additionally a need for a locker having a storage compartment that is configured such that liquids spilled or sprayed in the compartment will drain from the compartment. There is also a need for a locker that is strong, lightweight, and that may be produced inexpensively.

SUMMARY OF THE INVENTION

In accordance with a particularly preferred form of the present invention, there is provided a locker. The locker comprises a first side wall having an interlocking portion, a second side wall having a first interlocking portion engaging the interlocking portion of the first side wall and a second interlocking portion, and a third side wall having an interlocking portion engaging the second interlocking portion of the second side wall. The locker may also have at least two side walls that are cut from the same stock.

A coin receptacle for a coin operated locker is also provided. The coin receptacle comprises a channel having a cross-section and at least one coin operated locking mechanism, and defining an opening through which coins may fall, and a coin tray disposed below the channel having a cross-section greater than that of the channel. In a particular embodiment, the coin receptacle may further comprise a coin deflector mounted in the channel for deflecting coins into the coin tray.

A coin receptacle locking mechanism for mounting on a frame is also provided. The coin receptacle locking mechanism comprises a key operated barrel, a cam attached to the barrel, and a lock bar attached to the cam. The cam includes at least three lobes, wherein the first lobe engages the frame at a first point, the second lobe engages the frame at a second point, and the third lobe is pivotaly connected to the lock bar which engages the frame at a third point when the barrel is placed in a locked position. The coin receptacle locking mechanism may further comprise a tray attached to the locking mechanism and having a notch that engages the frame when the tray is placed in a closed position.

A self draining locker shelf is also provided. The shelf includes a member having a sloping surface and a perimeter, a plurality of parallel ribs upstanding from the sloping surface and defining a channel between each pair of ribs and above the sloping surface, and a rim attached to the perimeter of the member, wherein said rim has at least one opening in fluid communication with each channel. In one embodiment, the shelf also includes at least one interlocking member formed on the rim for slidable engagement with at least one complimentary interlocking member of a frame.

In addition, a locker door is disclosed, wherein the locker door includes a front cover, a backing member, and top and bottom caps. The front cover includes opposed interlocking members and the backing member has second opposed interlocking members for engagement with the opposed interlocking members of the front cover, whereby the front cover and the backing member define a gap therebetween. The top cap includes at least one ridge, wherein the top cap ridge is fitted within the gap between said front cover and said backing member and the bottom cap has at least one ridge, wherein bottom cap ridge is fitted within the gap between the front cover and the backing member.

A lock for a locker is also disclosed. The lock comprises a support member having an outward facing surface and an inward facing surface opposite the outward facing surface, and a locking mechanism attached to the inward facing surface.

A method of manufacturing a locker is also provided. The method comprises cutting a first wall from a first material to a desired length, cutting a second wall from the first material to the desired length, cutting a third wall to the desired length, and slidingly engaging the first, second and third walls.

A method of limiting access to a locking mechanism on a locker is furthermore provided. The method includes positioning the locking mechanism adjacent an inward facing surface and fastening the locking mechanism to the locker.

Accordingly, the present invention provides solutions to the shortcomings of prior lockers. The present invention is suitable for outdoor use, is strong and simple to manufacture, and may be formed primarily of light weight plastic if desired. A feature of the locker of the present invention is that it prevents spilled material and other forms of impurities in the locker from contacting personal possessions later placed in the locker. Another feature of the locker of the present invention is that it may be easily cleaned by directing pressurized water from a hose or other device into the locker storage compartment. It is also a feature of the present invention that it provides a storage compartment that is configured such that liquids spilled or sprayed in the compartment will drain from the compartment. An additional feature of the present invention is that it includes a large coin receptacle and a locking mechanism that secures the coin receptacle on each of four sides. Those of ordinary skill in the art will readily appreciate, however, that these and other details, features and advantages will become further apparent in the following detailed description of the preferred embodiments.

BRIEF DESCRIPTION OF THE DRAWINGS

In the accompanying Figures, there are shown present preferred embodiments of the invention wherein like reference numerals are employed to designate like parts and wherein.

DETAILED DESCRIPTION OF THE PREFERRED EMBODIMENTS

It is to be understood that the Figures and descriptions of the present invention included herein illustrate and describe elements that are of particular relevance to the present invention, while eliminating, for purposes of clarity, other elements found in a typical locker. Because the construction and implementation of such other elements are well known in the art, and because a discussion of them would not materially facilitate a better understanding of the present invention, discussion of those elements is not provided herein. It is also to be understood that the embodiments of the present invention that are described herein are illustrative only and are not exhaustive of the manners of embodying the present invention. For example, it will be recognized by those skilled in the art that the positions of the frame components including, for example, the hinge channel 40 and the lock channel 38, may be reversed if an alternate embodiment is preferred.

Figure 1:
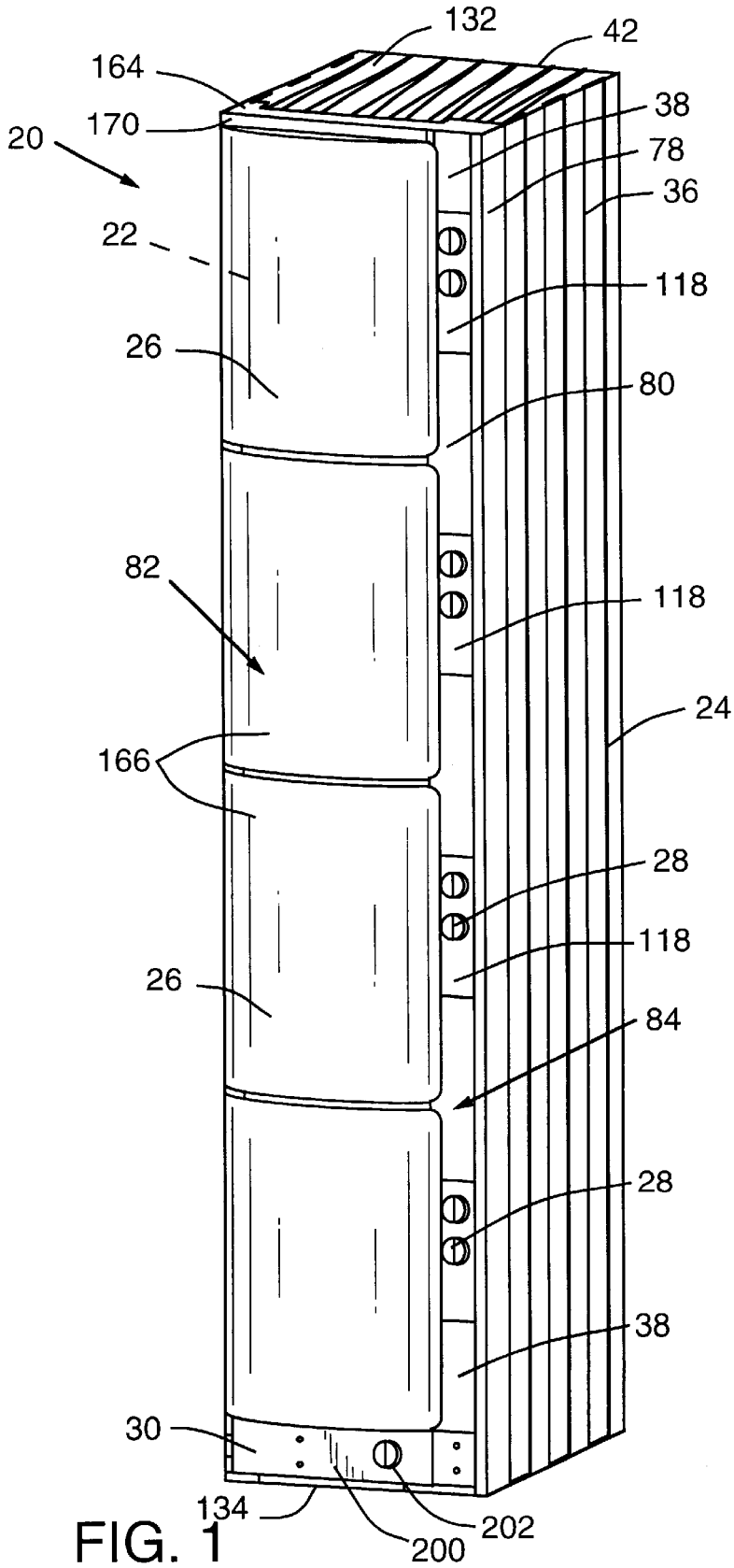
FIG. 1 is a perspective view of a locker of the present invention.
Figure 2:
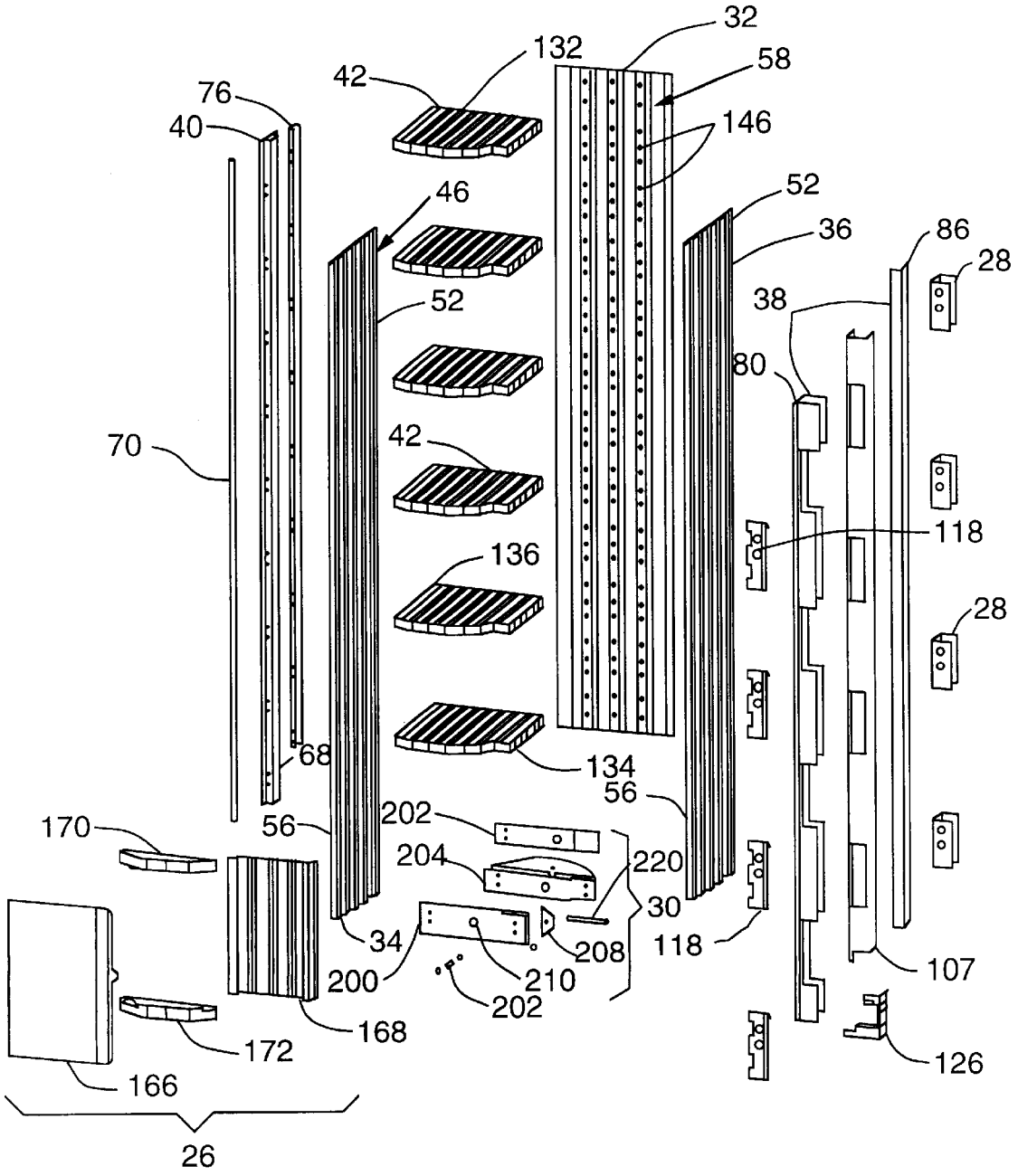
FIG. 2 is an exploded perspective view of the locker of FIG. 1.

Referring now to the drawings for the purpose of illustrating the present preferred embodiments of the invention only and not for the purpose of limiting the same, FIG. 1 is a perspective view of a locker 20 of the present invention having four storage compartments 22 and FIG. 2 is an exploded perspective view of the locker 20 of FIG. 1. FIGS. 3–7 are a front, a right side, a back, a top and a bottom view, respectively, of the locker 20 of FIGS. 1 and 2. The locker 20 of FIGS. 1–7 includes a frame 24, a door 26, a locking mechanism 28 for locking the door 26 and a coin receptacle 30. The frame 24 includes a rear panel 32, a left side panel 34, a right side panel 36, a lock channel 38, a hinge channel 40 and one or more shelves 42. Each of those components may be fabricated from many materials including, for example, plastic, steel and stainless steel. The skilled artisan will appreciate that the material from which the locker components described herein are fabricated may be advantageously selected based on their compatibility with, for example, the ambient conditions in which the locker will be utilized and the method and/or solvents utilized in cleaning the locker 20. For example, a locker 20 having a frame 24 fabricated of extruded plastic may advantageously be used in outdoor applications and may be cleaned by directing pressurized water on the frame 24 because an extruded plastic frame 24 is not prone to damage, such as rust, caused by precipitation or pressurized water. Furthermore, while the embodiment illustrated in FIGS. 1 and 2 includes four separately accessible compartments 22, the invention may include any number of compartments 22 desired. Thus, the invention should not be limited to a four compartment 22 arrangement.

Figure 3:
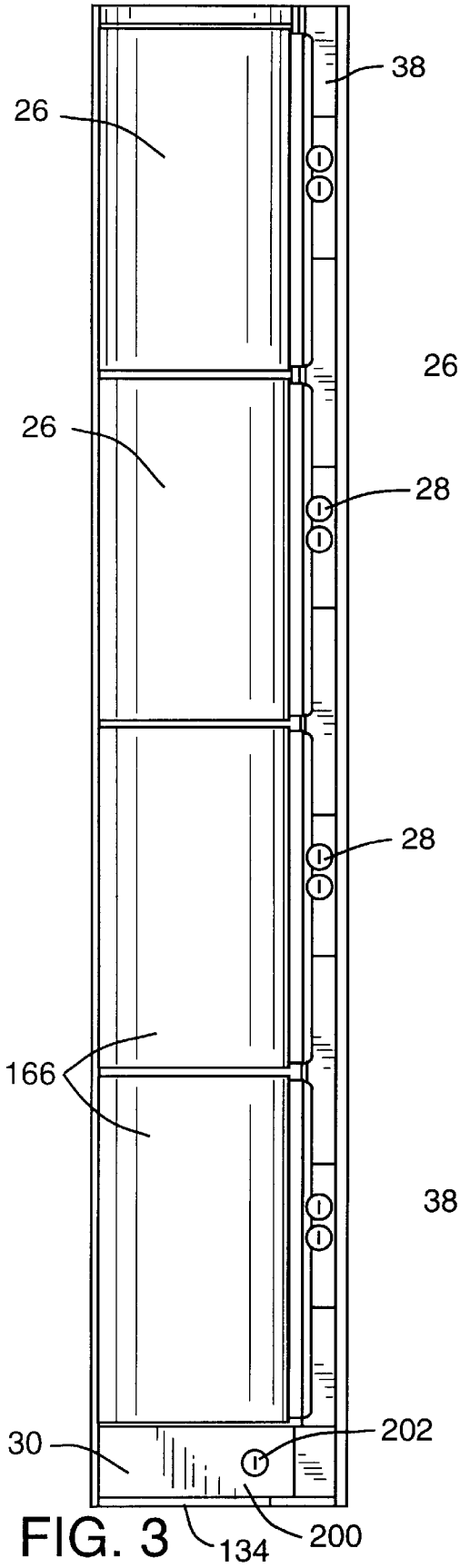
FIG. 3 is a front elevational view of the locker of FIGS. 1 and 2.
Figure 4:
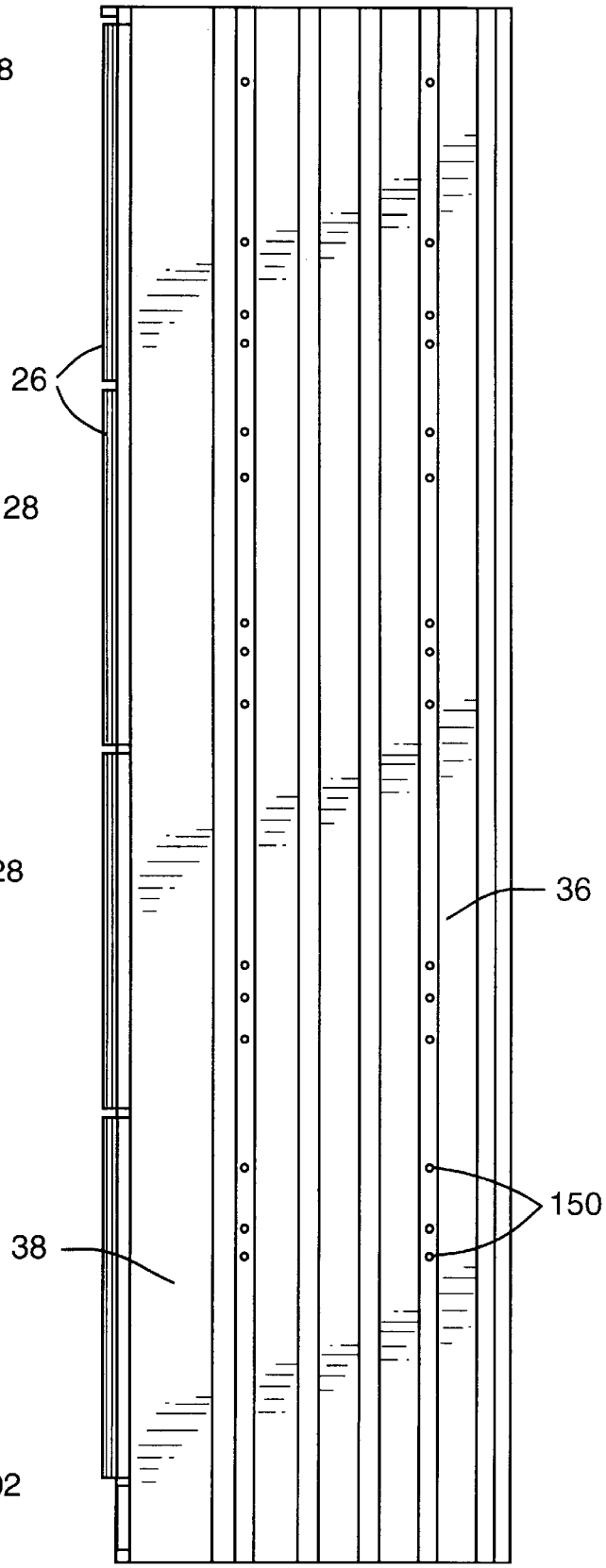
FIG. 4 is a right side elevational view of the locker of FIGS. 1–3.
Figure 5:
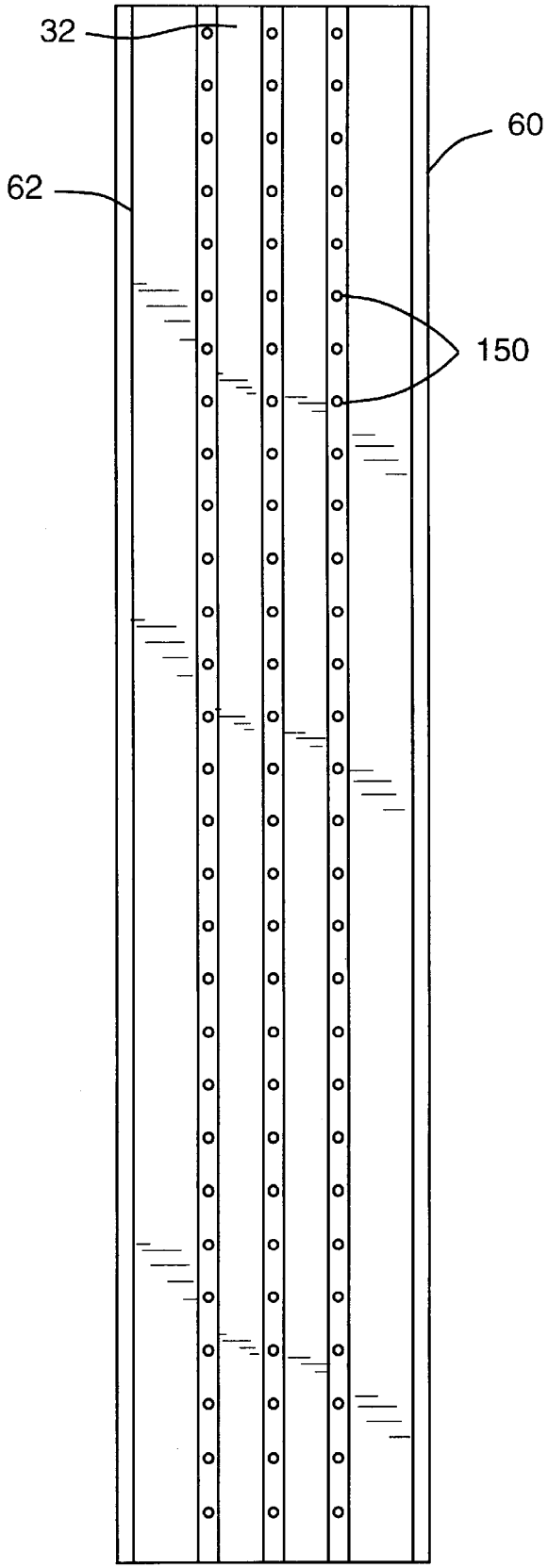
FIG. 5 is a rear elevational view of the locker of FIGS. 1–3.
Figure 8:
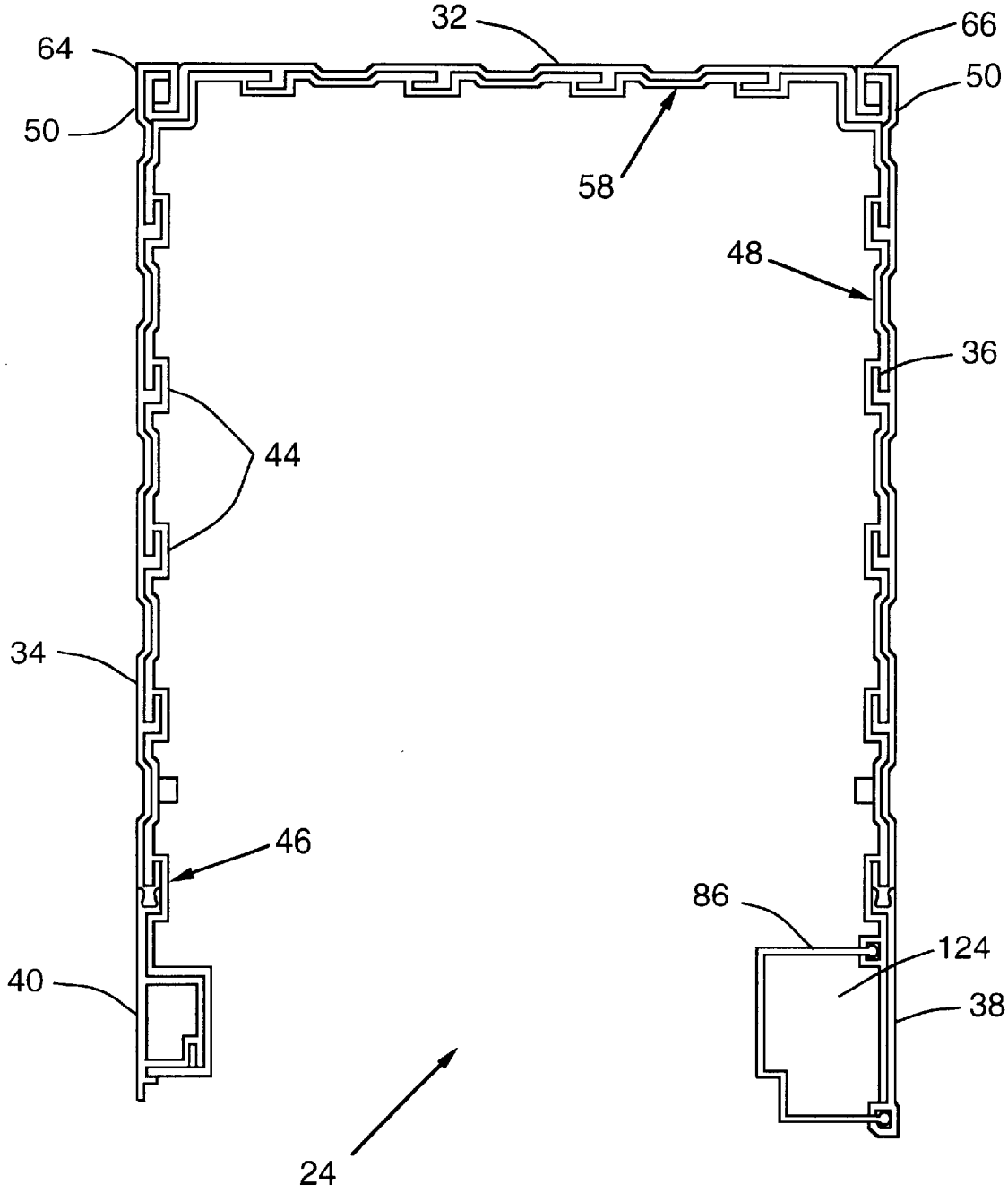
FIG. 8 is a top view of a locker frame of the present invention.
Figure 9:
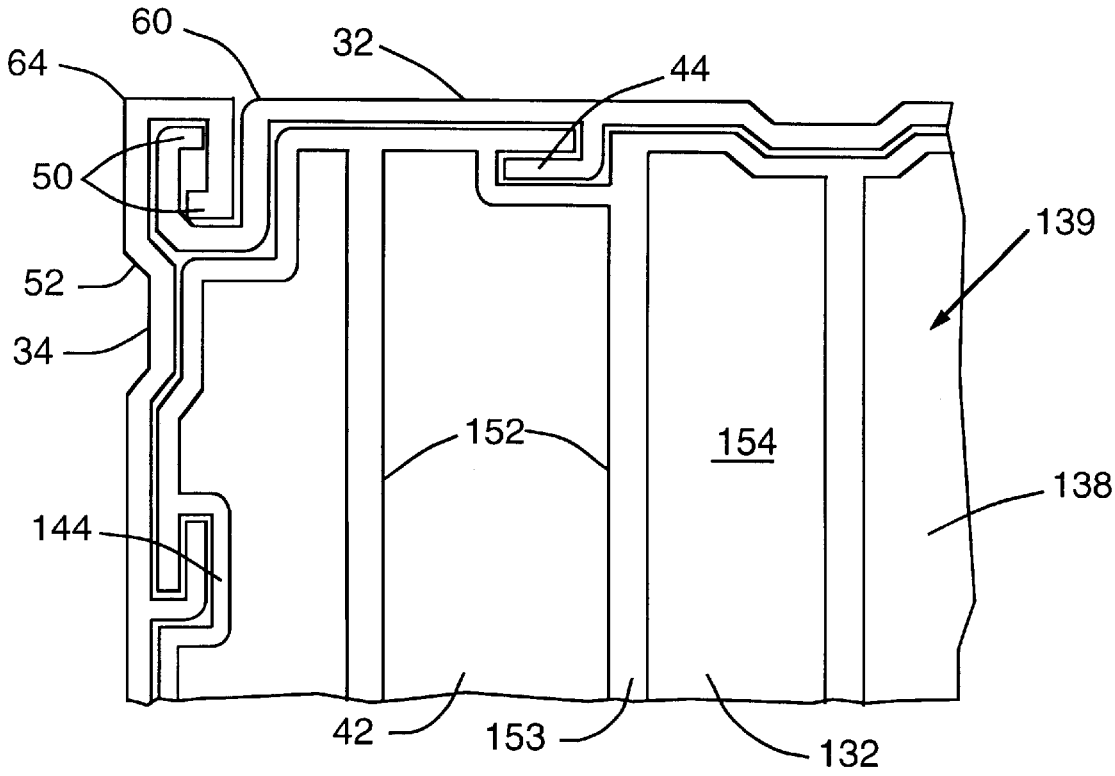
FIG. 9 is an enlarged top view of the left rear corner of the locker of FIGS. 1 and 2.

FIG. 4 illustrates a right side view of the locker 20 of FIGS. 1–3. The left side panel 34 and right side panel 36 may be cut to any desired length from the same side panel sheet (not shown). Use of a single panel sheet advantageously minimizes panel manufacturing costs by reducing the number of machines required to make the side panels and minimizing the variety of panels to be stored. The ability to simply cut the panels to any desired length also makes for simple manufacture of lockers of any height desired. The side panels 34 and 36 may be corrugated for strength and may include a plurality of L-locking tabs 44 running vertically along the inside surface 46 of the left side panel 34 and the inside surface 48 of the right side panel 36. One or both of the side panels 34 and 36 may also include a finger joint 50 along the rear vertical edge 52 and a T-locking tab 54 on the front vertical edge of the side panels 34 and 36. The rear panel 32, which is illustrated in FIG. 5, may also have one or more L-locking tabs 44 that run vertically along the inside surface 58 of the rear panel 32 and finger joints 50 along the left vertical edge 60 of the rear panel 32. FIG. 8 is a top view of the locker frame 24 without shelves 42 wherein the right side panel 36, left side panel 34 and rear panel 32 are interconnected by way of finger joints 50. FIG. 9 is an enlarged view of the left rear corner 64 of the locker 20, showing the interconnected finger joints 50 of the left side panel 34 and the rear panel 32. FIG. 9 also depicts a shelf 42 that is interlocked with the L-locking tabs 44 of the left side panel 34 and the rear panel 32. The interconnection of the shelf 42 with the side panels 34 and 36 and rear panel 32 is discussed further hereinbelow. The finger joint 50 of the right side panel 36 may also be slidingly interlocked with the finger joint 50 of the right vertical edge 62 of the rear panel 32. The use of finger joints 50 to connect the side and rear panels 34, 36 and 32 is beneficial because the sliding connection simplifies manufacture. This is because the left rear frame corner 64 and right rear frame corner 66 formed by the interconnecting finger joints 50 are difficult to separate and because those corners 64 and 66 form rigid vertical supports.

Figure 10:
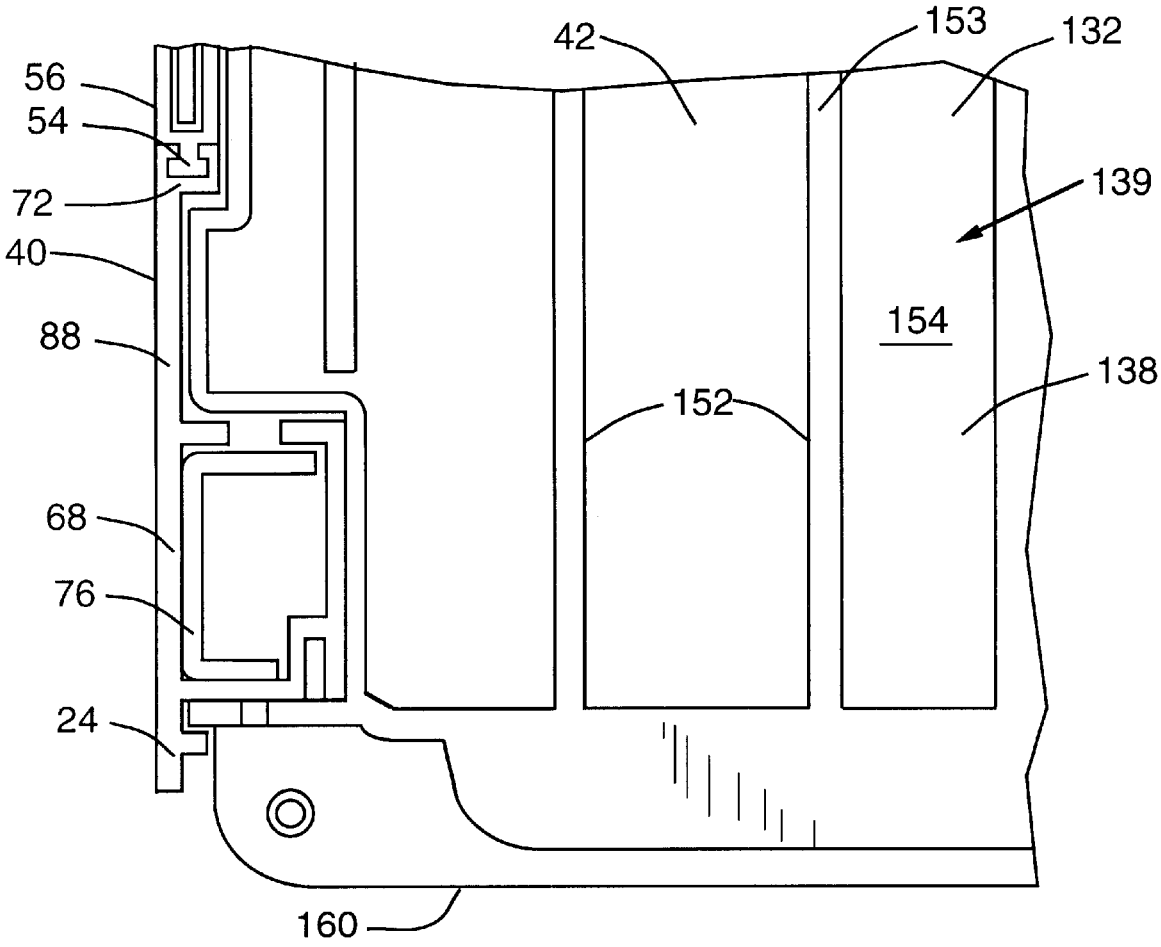
FIG. 10 is an enlarged top view of a portion of the locker of FIGS. 1 and 2 that includes a hinge channel.

FIG. 10 is an enlarged top view of a portion of the locker 20 that includes the hinge channel 40 of the locker frame 24. The hinge channel 40 includes a U-shaped section 68 to which hinge components such as a torsion spring (not shown) for biasing the door 26 closed and any frontally positioned component may be attached. A T-locking channel 72 may be formed along the rear vertical edge 88 of the hinge channel 40 for receiving the T-locking tab 54 of the left side panel 34. In that embodiment, the T-locking tab 54 slides into the T-locking channel 72 to interlock those components. Also in the embodiment illustrated, a reinforcement channel 76 is inserted into the hinge channel 40. Thus components attached to the hinge channel 40 may be fastened through the reinforcement channel 76 to provide additional strength. The reinforcement channel 76 may be fabricated from aluminum or stainless steel so as to provide added strength for secure connection of frontally positioned components and to resist corrosion. The hinge channel 40 and reinforcement channel, therefore, beneficially provide a strong, continuous attachment area.

Figure 11:
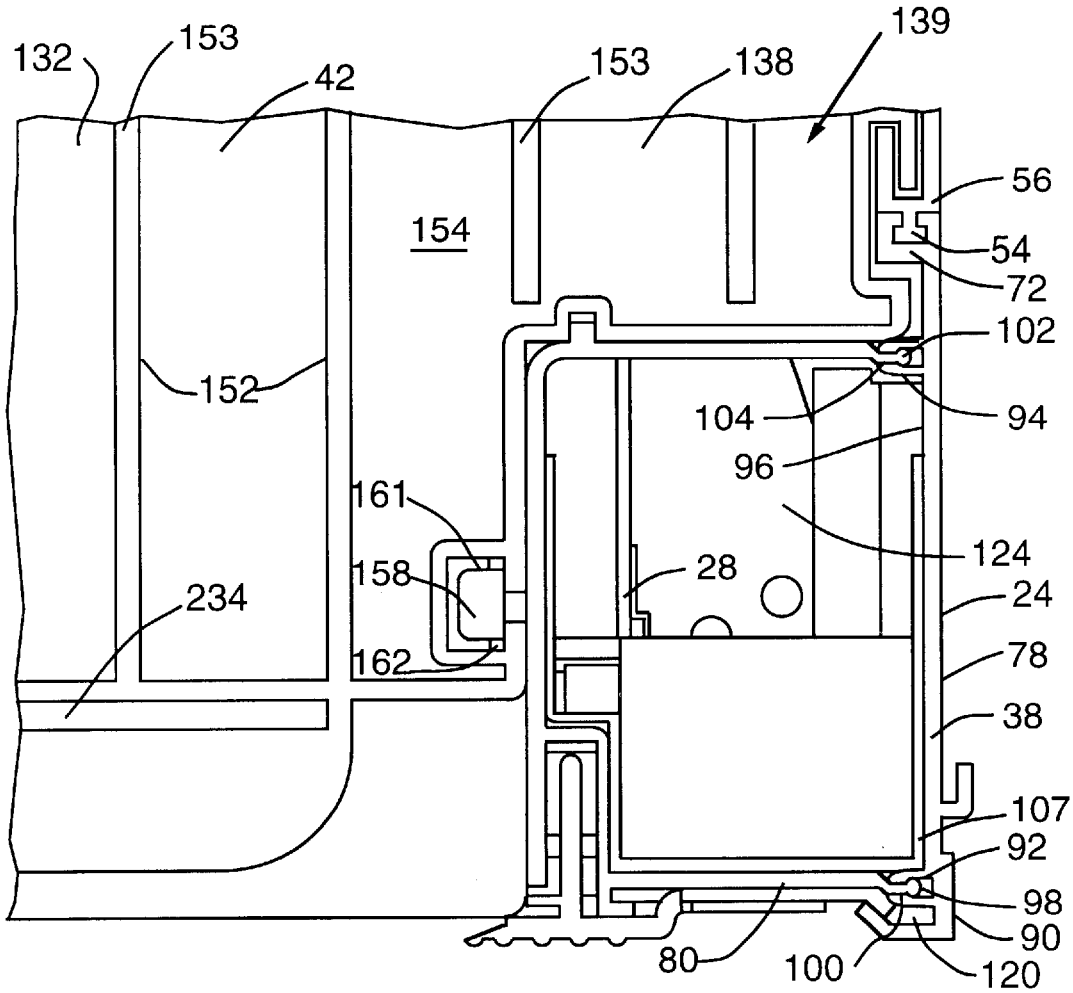
FIG. 11 is an enlarged top view of a portion of the locker of FIGS. 1 and 2 that includes a lock channel.
Figure 12:
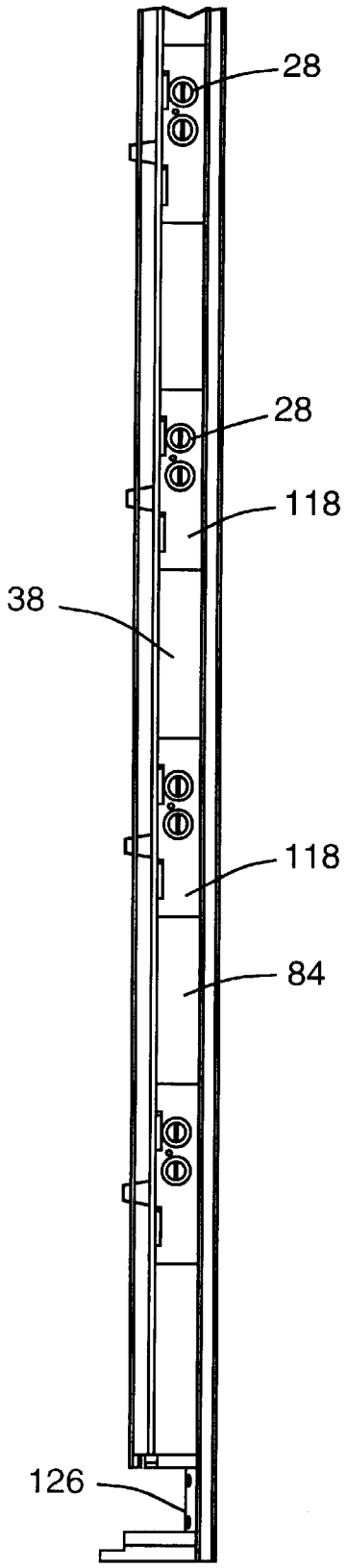
FIG. 12 is a front view of the lock channel of the present invention.
Figure 13:
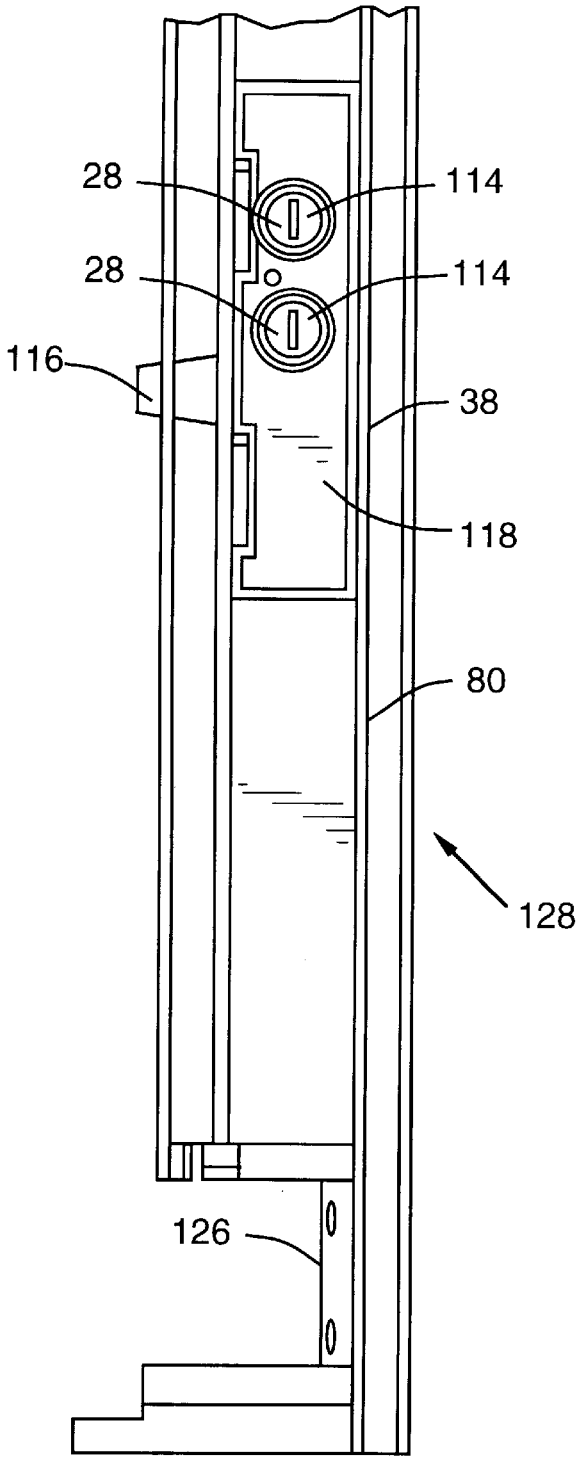
FIG. 13 is an enlarged front view of the lower portion of the lock channel of FIG. 12.
Figure 14:
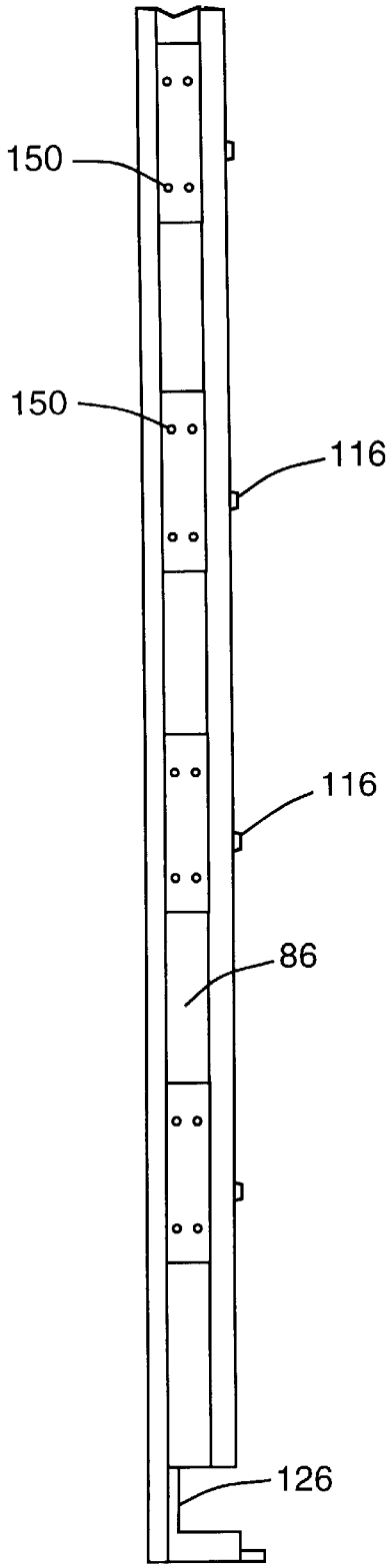
FIG. 14 is a rear view of the lock channel of FIG. 12.
Figure 15:
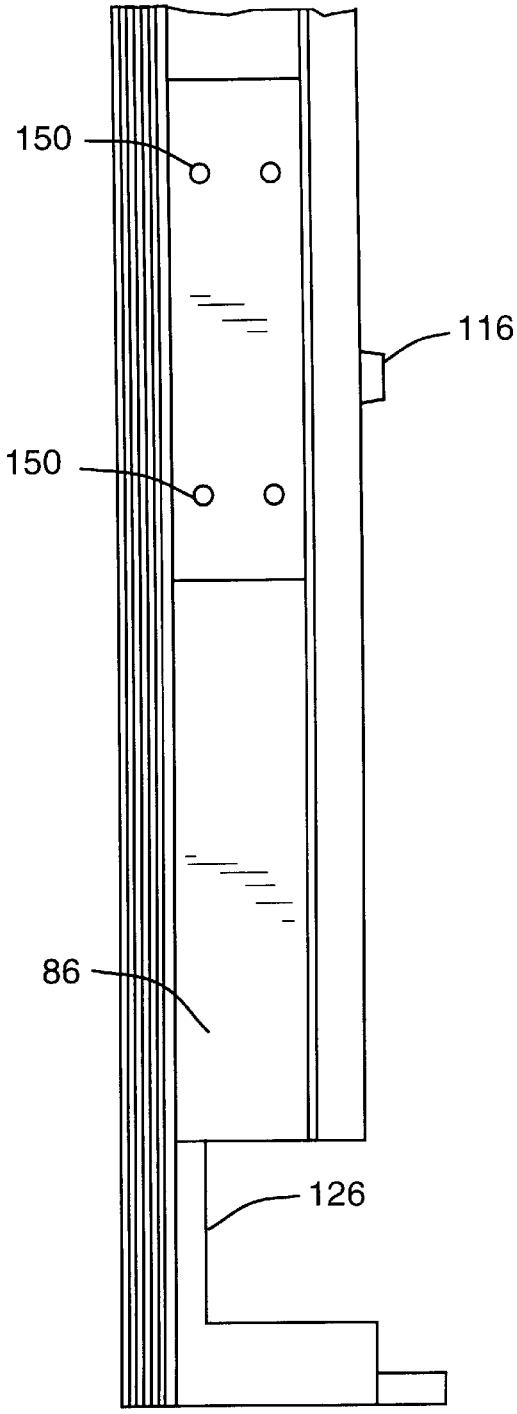
FIG. 15 is an enlarged rear view of the lower portion of the lock channel of FIG. 14.
Figure 16:
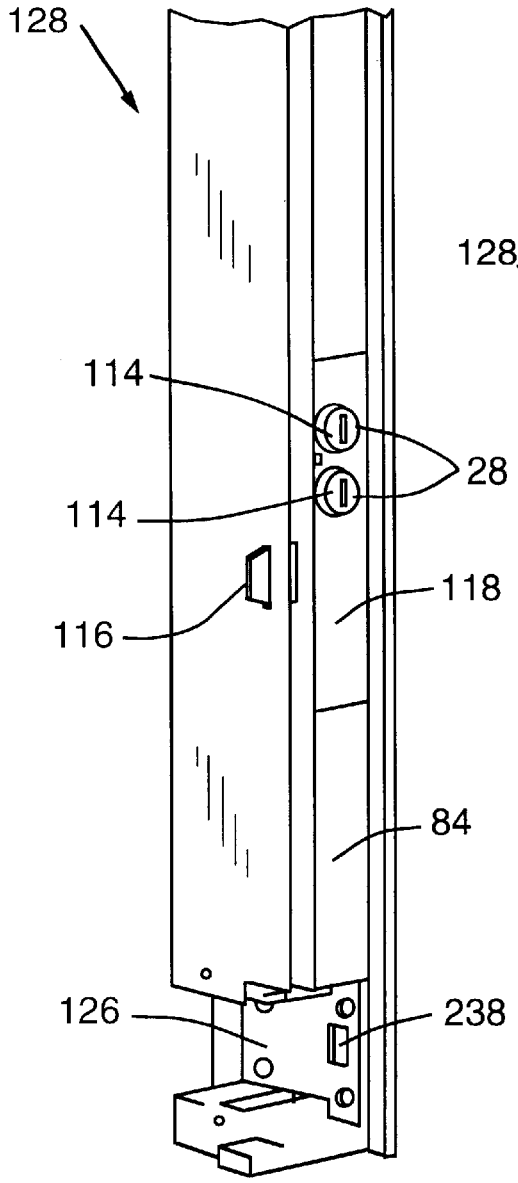
FIG. 16 is an enlarged perspective view of the lower portion of the lock channel of FIGS. 12 and 14.
Figure 17:
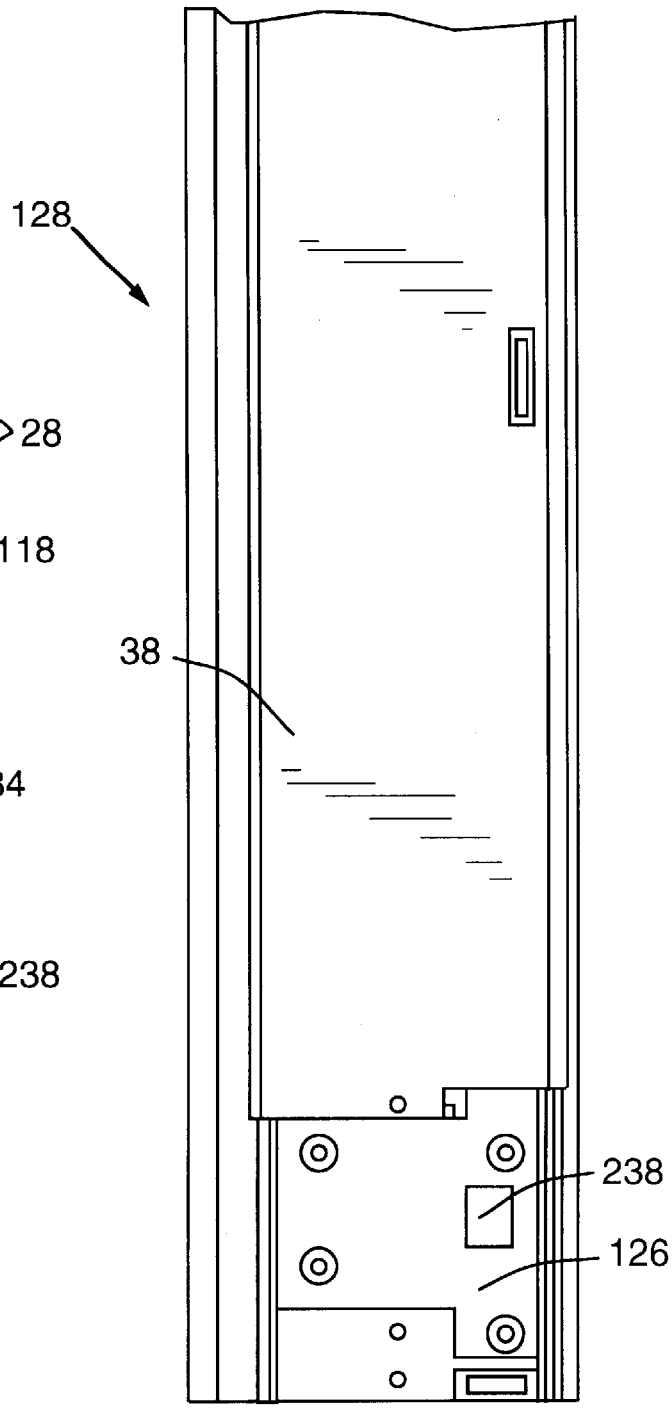
FIG. 17 is an enlarged left side view of the lower portion of the lock channel of FIGS. 12 and 14.

FIG. 11 is an enlarged top view of a portion of the locker 20 that includes the lock channel 38. The lock channel 38 is sized to hold a standard locking mechanism 28 and to direct coins that have been inserted into the locking mechanism 28 to the coin receptacle 30. In the embodiment illustrated in FIG. 11, the lock channel 38 is provided in two sections: a flat side section 78, and a U-shaped section 80 into which a locking mechanism 28 is inserted. A shortcoming of many known lockers is that locking mechanisms 28 are typically inserted into a locker frame 24 from the front 82 of the locker 20 and attached through the front 82 of the locker 20. When a locking mechanism 28 is so inserted, vandals have been known to disconnect the locking mechanism 28 and thereby gain access to the storage compartment 22 or coins held inside the lock channel 38. The locking mechanism 28 of the present invention may be inserted into the lock channel 38 from the rear 86 of the channel and secured from the rear 86, making removal of the locking mechanism 28 by prying or pulling through the front 82 of the locker 20 difficult. In the embodiment illustrated, the flat side section 78 has a T-locking channel 72 formed along a rear vertical edge 88 that slidingly accepts the T-locking tab 54 of the right side panel 36. The front vertical edge 90 of the flat side section 78 of the lock channel 38 has a first bead channel 92 formed thereon, and a second bead channel 94 is located on an inner surface 96 of the flat side section 78. Also in the embodiment illustrated, the U-shaped section 80 of the lock channel 38 has a first bead 98 formed along a front edge 100 and a second bead 102 formed along a rear edge 104. The first bead 98 slidingly engages the first bead channel 92 and the second bead 102 slidingly engages the second bead channel 94 to form the lock channel 38. FIG. 12 is a front view of the lock channel 38 having locking mechanisms 28 mounted therein and FIG. 13 is an enlarged front view of the lower portion of the lock channel 38. FIG. 14 is a rear view of the lock channel 38 having locking mechanisms 28 mounted therein and FIG. 15 is an enlarged rear view of the lower portion of the lock channel 38. In addition, FIG. 16 is an enlarged perspective view of the lower portion of the lock channel 38 and FIG. 17 is an enlarged left side view of the lower portion of the lock channel 38. FIGS. 16 and 17 also illustrate a portion of the coin deflector 126 which is described hereinbelow.

Figure 18:
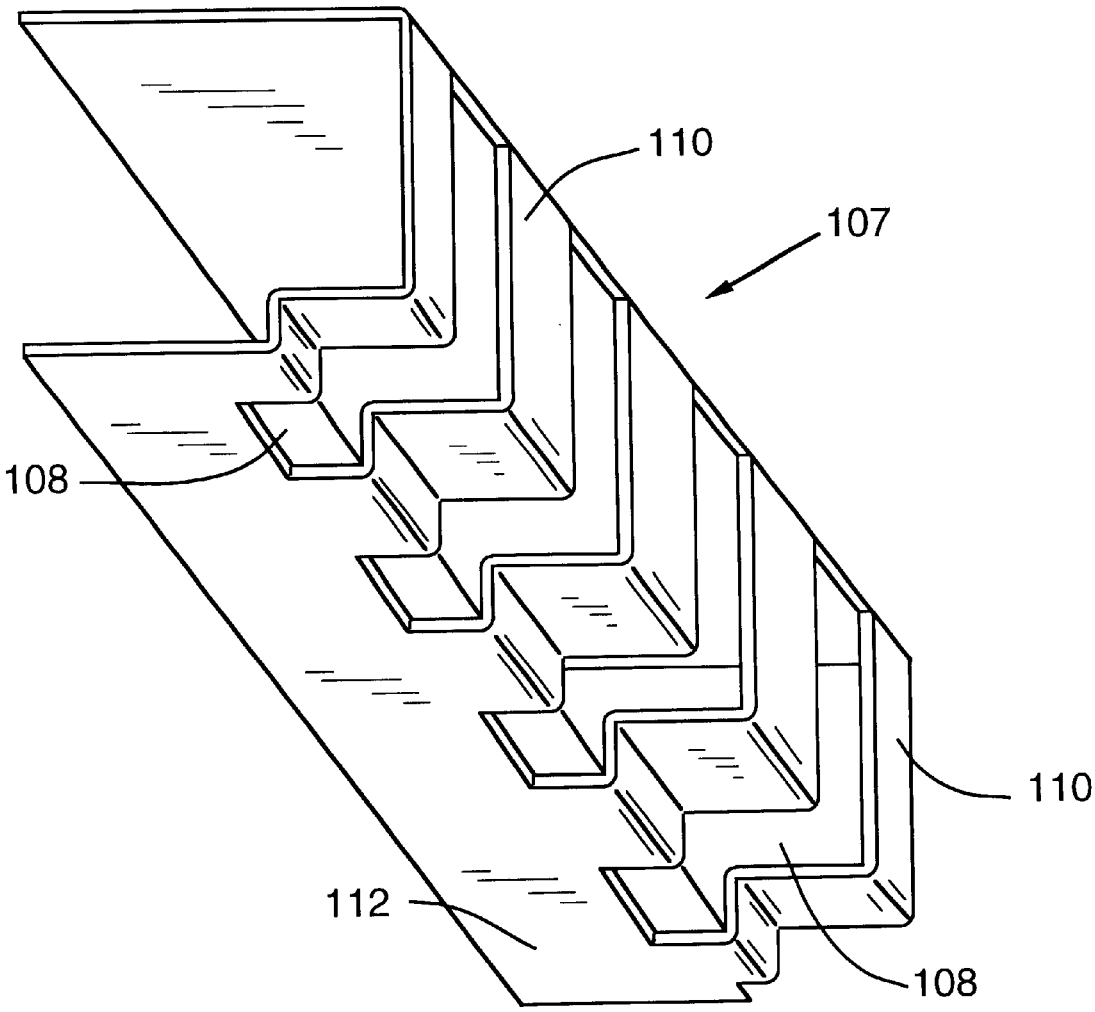
FIG. 18 is a perspective view of a lock channel reinforcement channel of the present invention.
Figure 19:
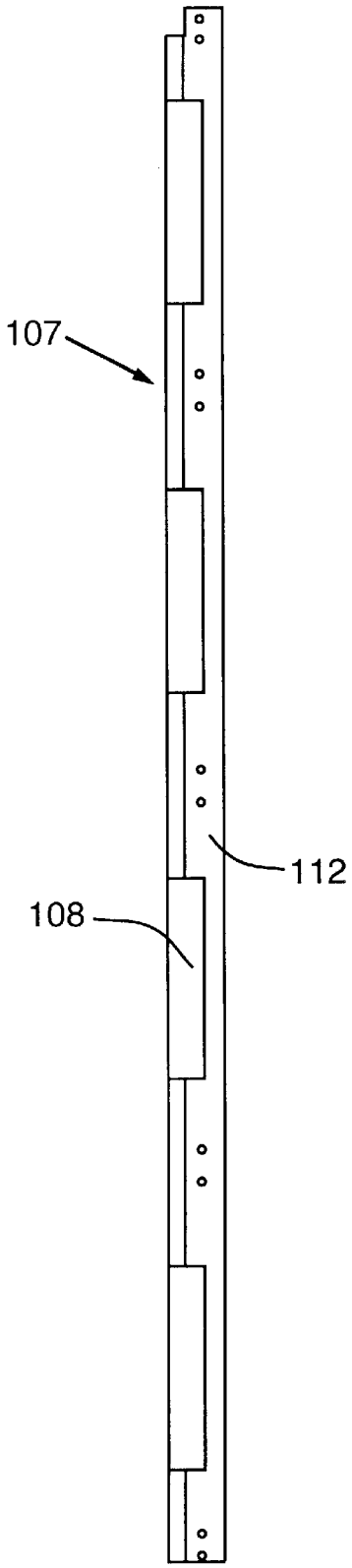
FIG. 19 is a left side view of the lock channel reinforcement channel of FIG. 18.
Figure 20:
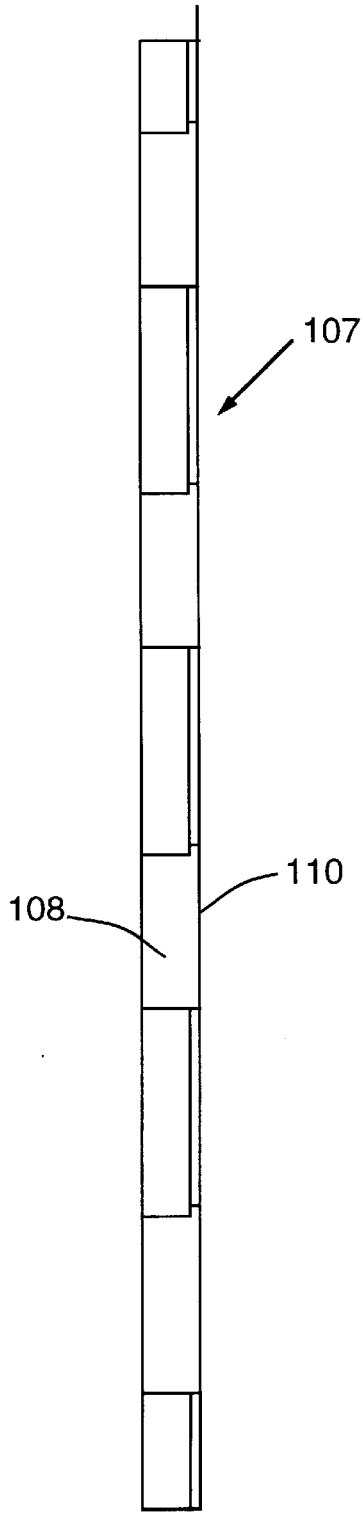
FIG. 20 is a front view of the lock channel reinforcement channel of FIG. 18.
Figure 21:
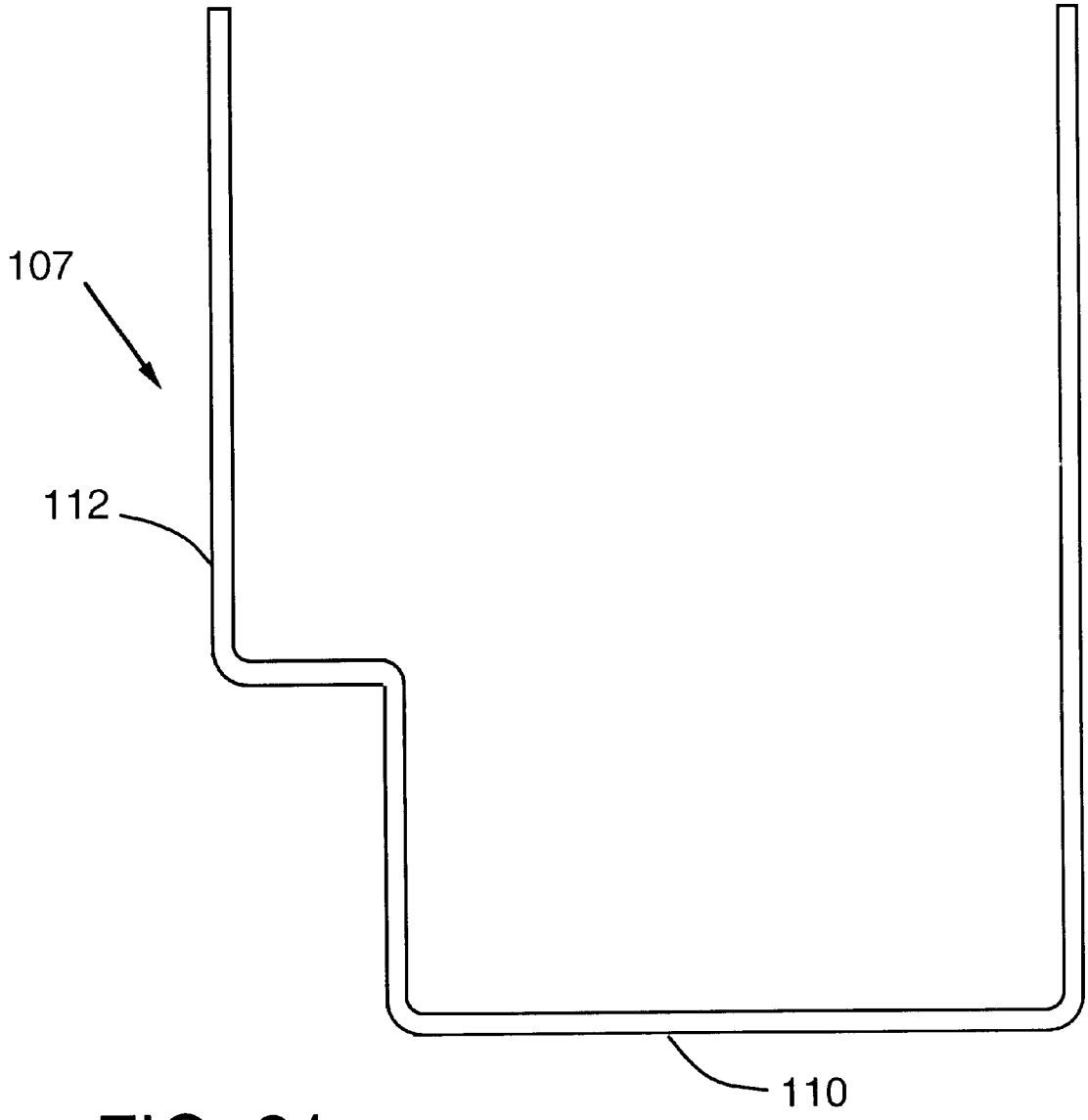
FIG. 21 is an end view of the lock channel reinforcement channel of FIG. 18.

FIGS. 18–21 illustrate the lock channel reinforcement channel 107. FIG. 18 is a perspective view of the lock channel reinforcement channel 107, FIG. 19 is a left side view of the lock channel reinforcement channel 107, FIG. 20 is a front view of the lock channel reinforcement channel 107 and FIG. 21 is an end view of the lock channel reinforcement channel 107. Like the hinge channel reinforcement channel 76, the lock channel reinforcement channel 107 may be fabricated, for example, from aluminum or stainless steel so as to provide added strength for secure connection of frontally positioned components, to resist corrosion and to protect the locking mechanism 28 and the portion of the lock channel 38 through which coins are directed from access by vandals. The lock channel reinforcement channel 107 is sized to fit inside the lock channel 38. The reinforcement channel 107 also includes an opening 108 along the front 110 and left side 112 of the reinforcement channel 107 through which a key barrel 114 and bolt 116 of the locking mechanism 28 may extend.

Figure 22:
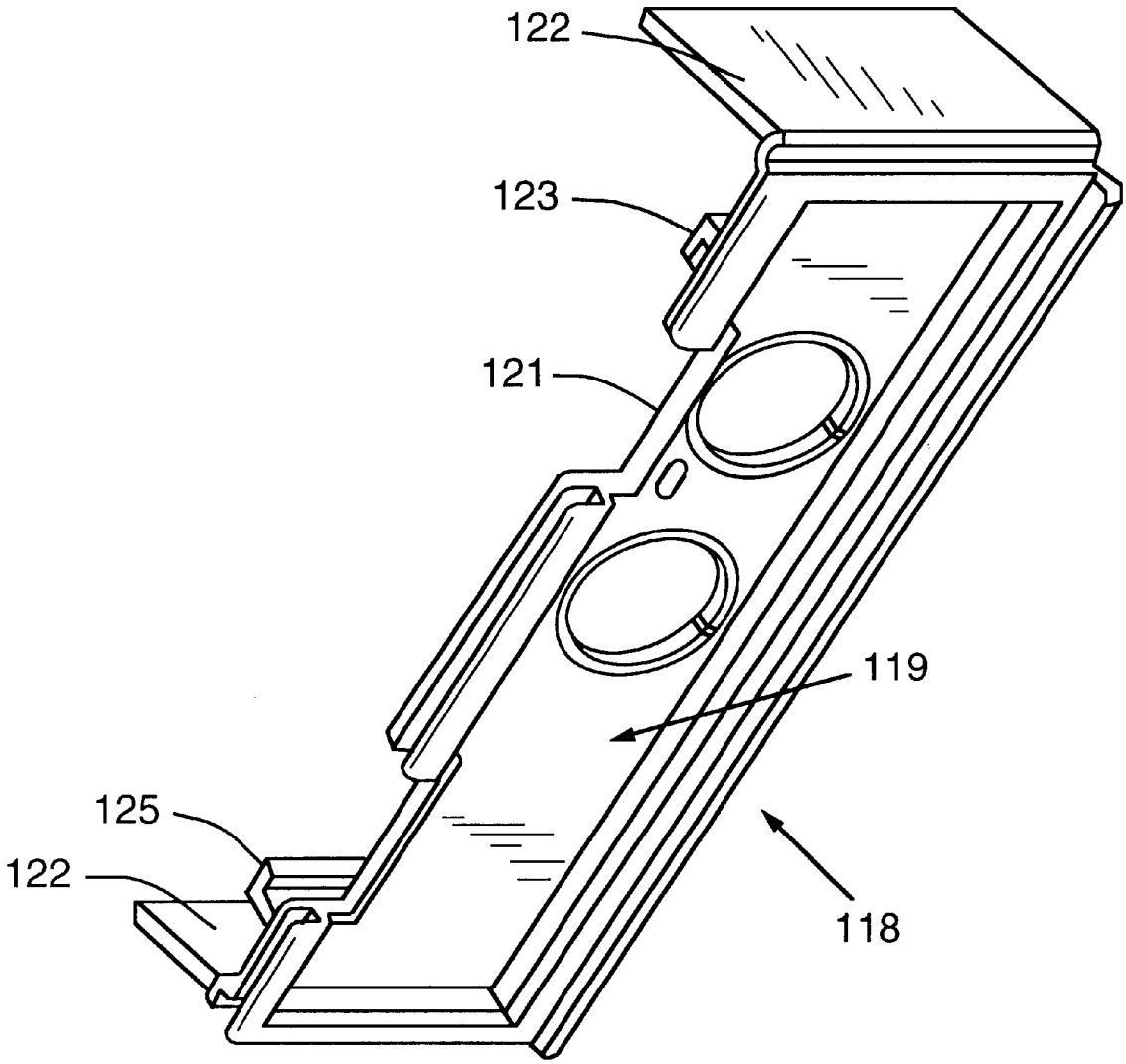
FIG. 22 is a perspective view of a locking mechanism cover of the present invention.

FIG. 22 is a perspective view of a locking mechanism cover 118 of the present invention. As illustrated in FIG. 11, the lock channel 38 may include a cover channel 120 in which the locking mechanism cover 118 may be secured. The locking mechanism cover 118, in turn, may provide a structure for retaining a standard locking mechanism 28 in proper position. The locking mechanism cover 118 includes an outer surface 119 and an inner surface 121 and may include a fastener such as, for example the upper clamp 123 and lower clamp 125 illustrated in FIG. 22, to which the locking mechanism 28 may be fastened. The locking mechanism cover 118 may also include one or more cover deflectors 122 to deflect coins falling from above the cover to the open rear portion 124 of the lock channel 38, through which the coins may pass in transit to the coin receptacle 30.

Figure 23:
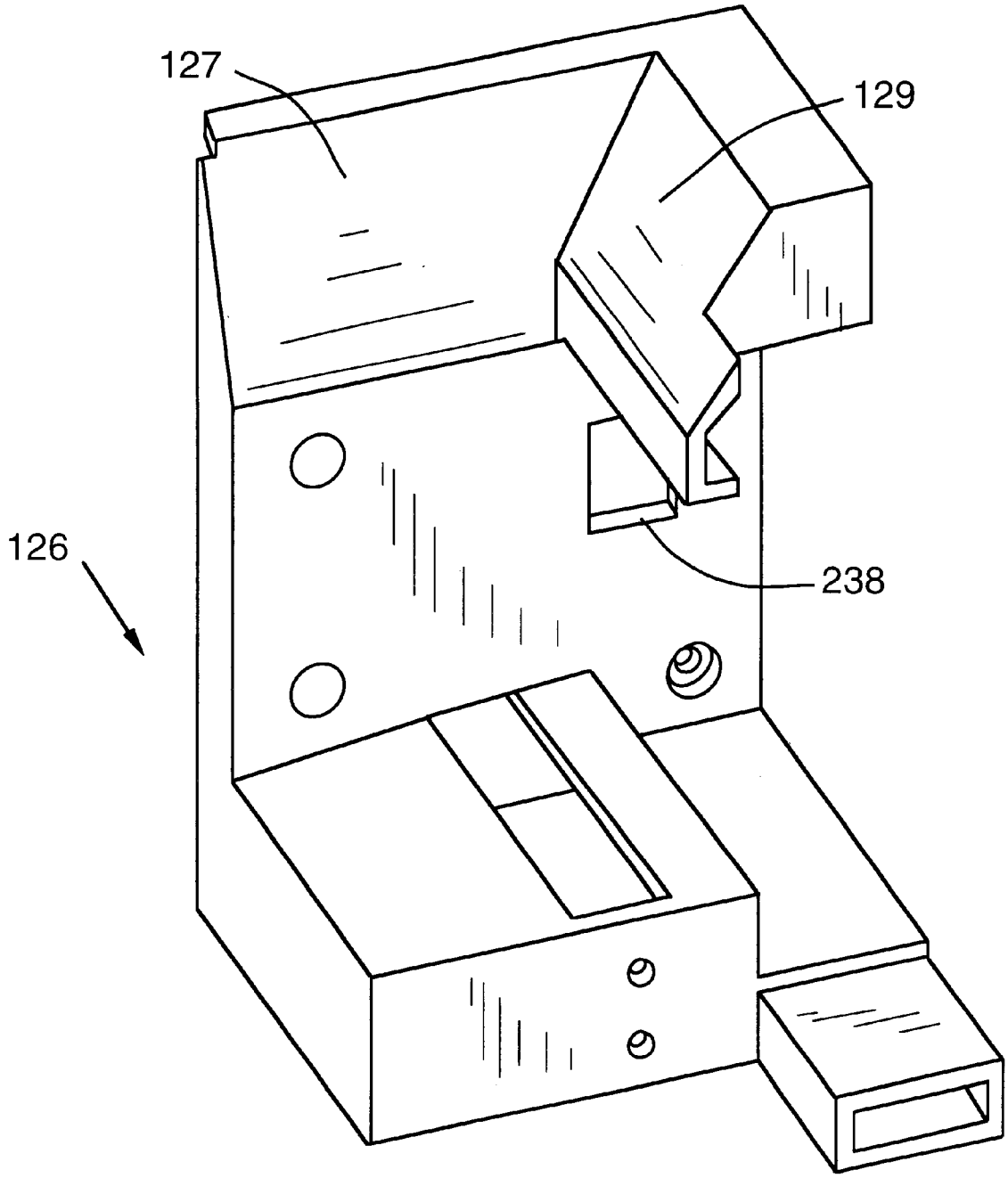
FIG. 23 is a perspective view of a coin deflector of the present invention.

FIG. 23 is a perspective view of a coin deflector 126 having a first angled side 127 and a second angled side 129 and which may be disposed at the lower portion 128 of the lock channel 38 to deflect coins toward the center 130 of the coin receptacle 30. In conventional lockers, coins fall into a small receptacle located beneath the locking mechanism 28. The present invention, however, beneficially provides for the lock channel 38 to be cut away so that coins may be stored in a much larger receptacle 30. Therefore, the coin deflector 126 is useful in that it deflects falling coins toward the center 130 of the coin receptacle 30, thereby avoiding build-up and overflow of coins in the coin receptacle 30. The coin receptacle 30 is discussed in more detail hereinbelow.

Figure 24:
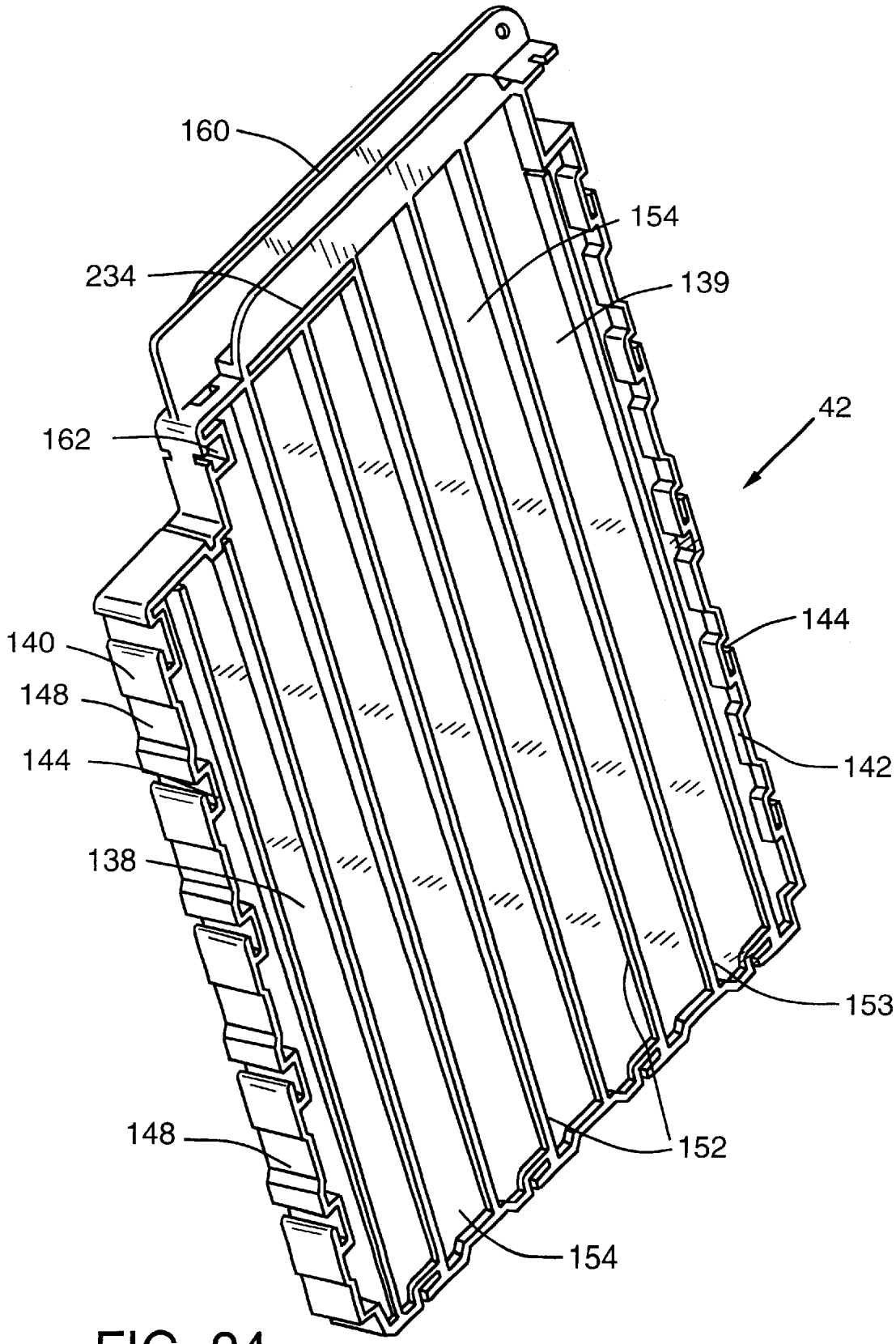
FIG. 24 is a perspective view of a shelf of the present invention.
Figure 25:
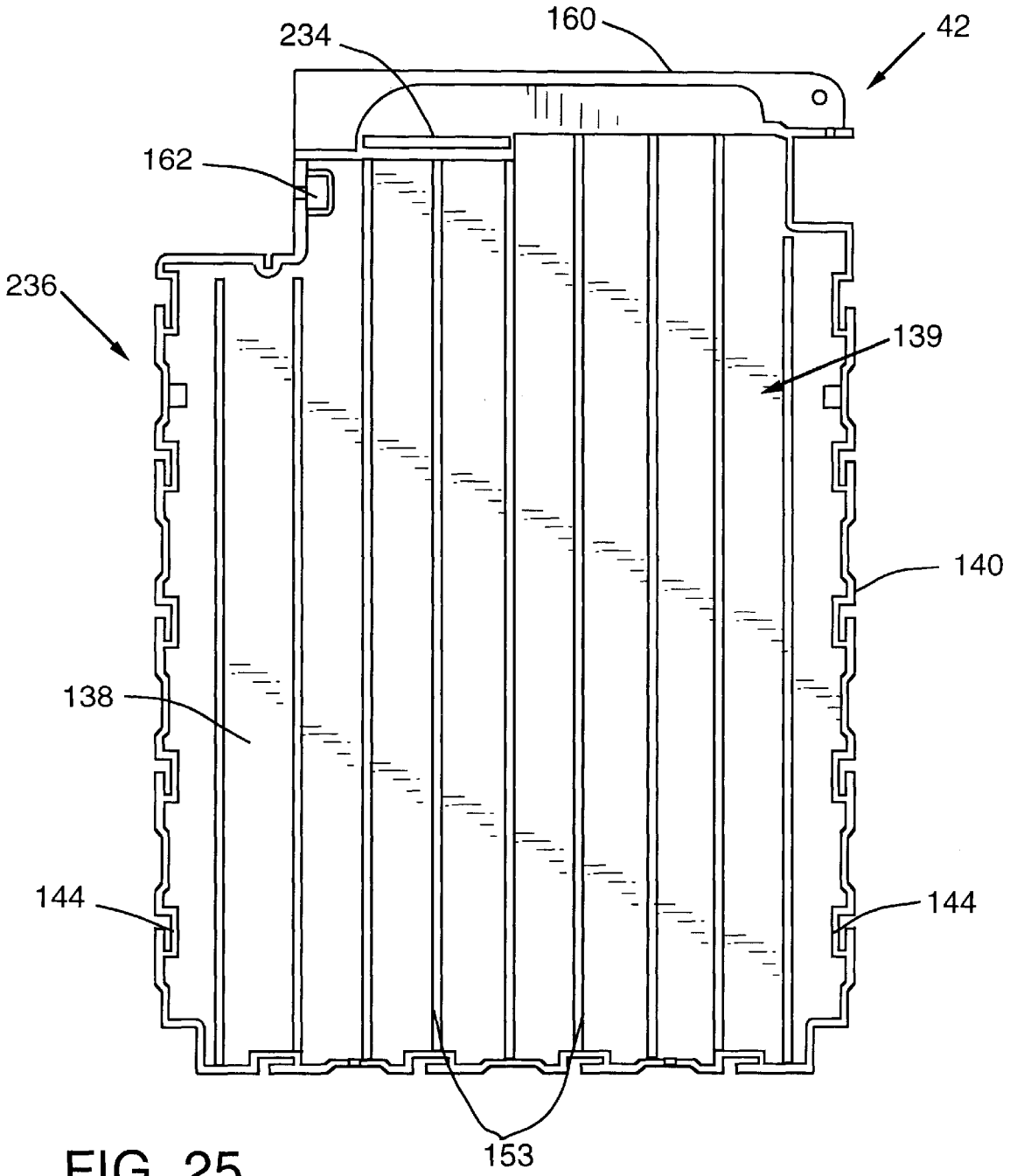
FIG. 25 is a top view of the shelf of FIG. 24.
Figure 26:
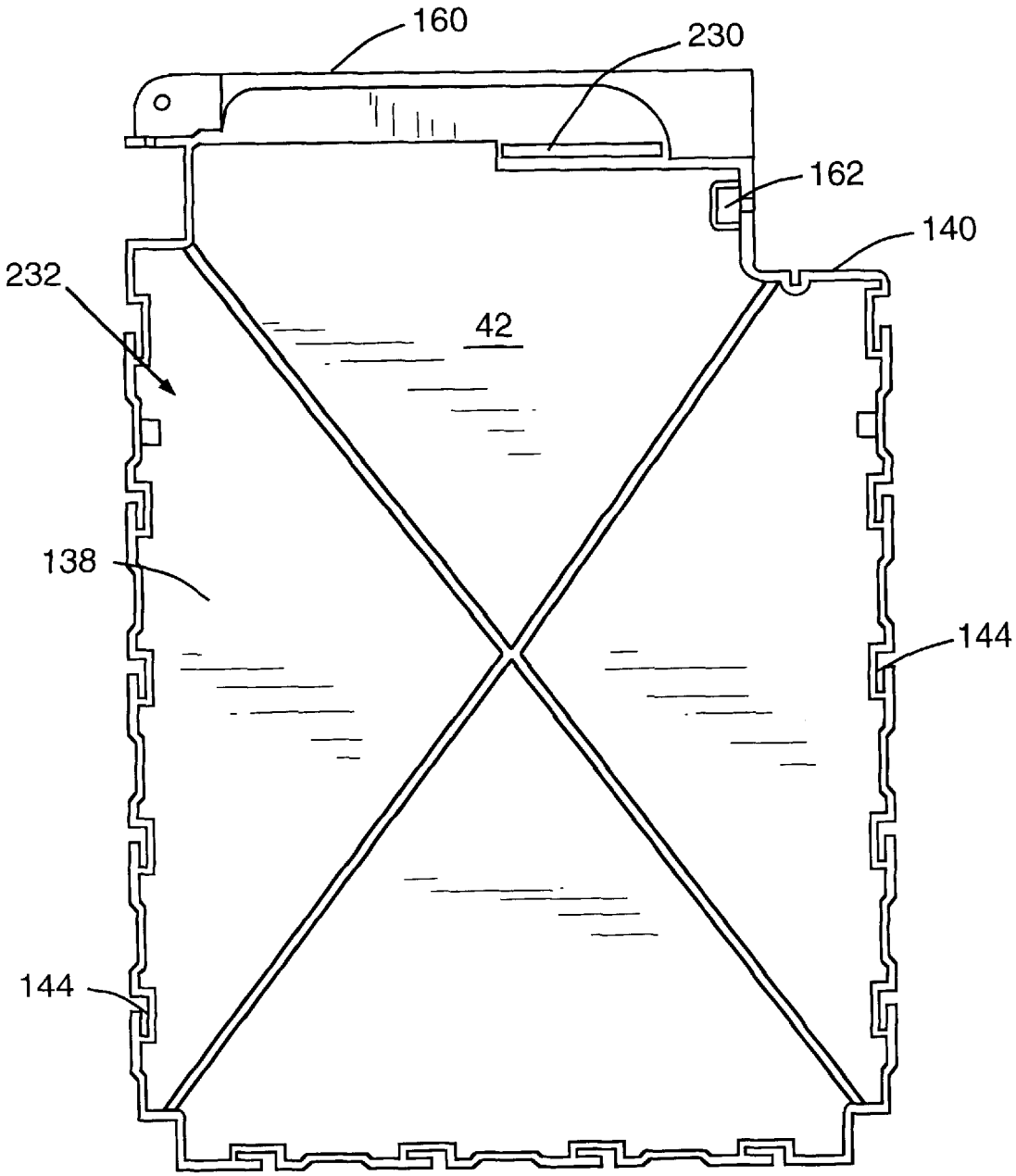
FIG. 26 is a bottom view of the shelf of FIG. 24.

FIG. 24 is a perspective view of the shelf 42 of the present invention. FIG. 25 is a top view and FIG. 26 is a bottom view of the shelf 42 of FIG. 24. One or more shelves may be inserted into the frame 24 to separate compartments 22. Shelves may also be utilized as an upper cover 132, as a base 134 and as a separator 136 to be placed above the coin receptacle 30 as shown in FIG. 2. In the embodiment illustrated, each shelf 42 includes a member 138 and an endless upright rim 140 attached to the perimeter 142 of the member 138. The rim 140 furthermore includes a plurality of L-locking channels 144, each of which is sized to accept one of the L-locking tabs 44 of the side and back panels 34, 36 and 32. By interlocking the frame 24 with the shelves, additional structural rigidity is provided to the frame 24 of the present locker 20. The vertical location of each shelf 42 within the locker 20 is infinitely adjustable because the L-locking channels 144 of each shelf 42 will slide along the L-locking tabs 44 to any desired location. Known mechanisms for fastening may be utilized to attach the shelf 42 to the frame 24 in the desired location. For example, holes 146 may be punched in the side and back panels 34, 36 and 32 and aligned with pre-punched holes 148 in each shelf 42 and rivets 150 may be placed through the aligned holes 146 and 148 to secure the shelf 42 in the desired location.

Figure 27:
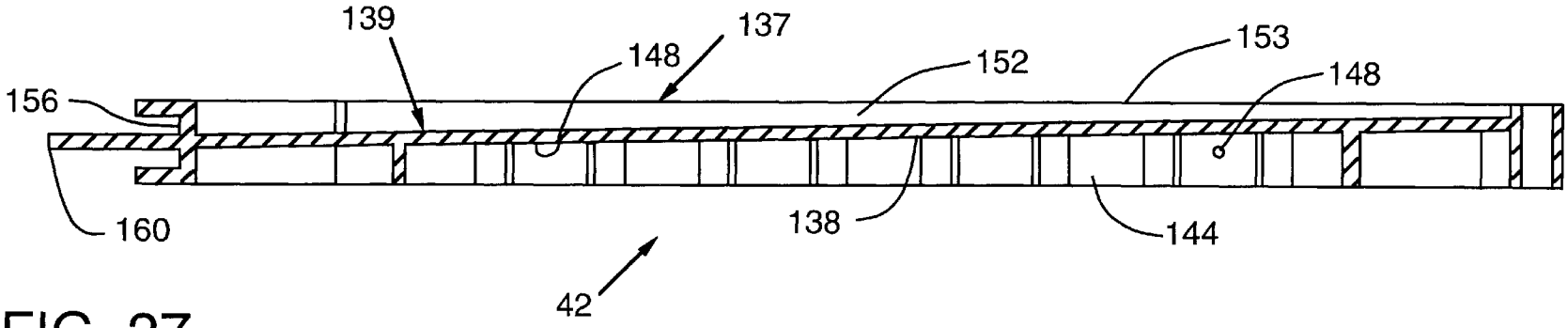
FIG. 27 is a cross-sectional view of the shelf of FIGS. 24–26.

FIG. 27 is a cross-sectional view that illustrates the sloped member 138 and upstanding ribs 152 of the shelf 42 of FIGS. 24–26. Conventional lockers are susceptible to becoming soiled through, for example, spills within the locker 20 and placement of sticky materials on the locker shelves 42. The shelves 42 of the present invention are beneficially configured to discharge spilled liquids from the locker compartments 22 and provide an upper surface 137 on which items may be placed to avoid contact with soil on a lower surface 139 of the shelf 42. The member 138 of each shelf 42 slopes toward the front 160 of the shelf 42. A plurality of upstanding ribs 152 extend up from the sloping lower surface 139 of the member 138 to define the upper surface 137 along a plane defined by the upper edges 153 of the ribs 152. The upper edge 153 of each rib 152 is substantially horizontal such that sloping channels 154 are defined between the horizontal ribs 152. Drain openings 156 are also provided through the rim 140 along the member 138 in the embodiment illustrated, such that liquids that enter the channels 154 will drain through the openings 156 and thereby exit the locker 20. Those liquids could enter the channel by, for example, spills occurring within the locker 20 or by directing pressurized water into the storage compartments 22 to clean the locker 20. It has furthermore been discovered through experimentation that a member 138 sloped at an approximately 1° angle is sufficient to cause liquids in the channels 154 to drain from the member 138. The sloping member 138 and parallel rib 152 configuration is therefore beneficial in that it provides for easy cleaning, particularly in outdoor installations. For example, the present locker 20 may be cleaned simply by directing pressurized water into each storage compartment 22. In that way, any soil in the storage compartment 22 is removed by the pressurized water and carried into the channels 154 from which the water and soil will flow through the openings 156, thereby exiting the locker 20. The sloping member 138 and parallel rib 152 configuration is also beneficial in protecting personal belongings from soil that exists on the member 138 by providing the upper surface 137 on which personal items may be placed so as not to contact any soil in the channels 154.

Figure 28:
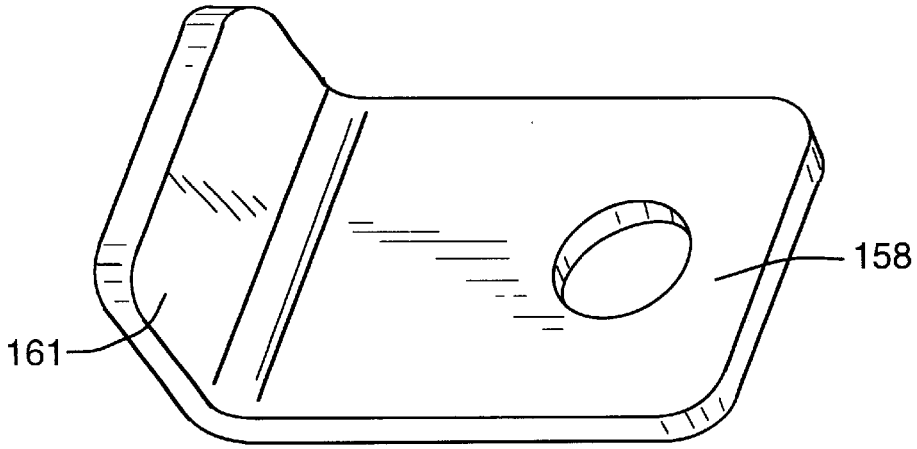
FIG. 28 is a perspective view of a shelf support of the present invention.
Figure 29:
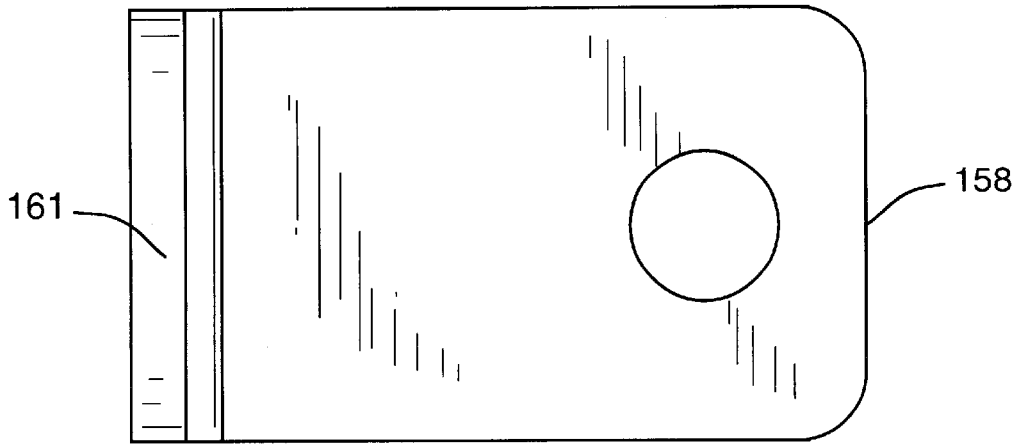
FIG. 29 is a front view of the shelf support of FIG. 28.
Figure 30:
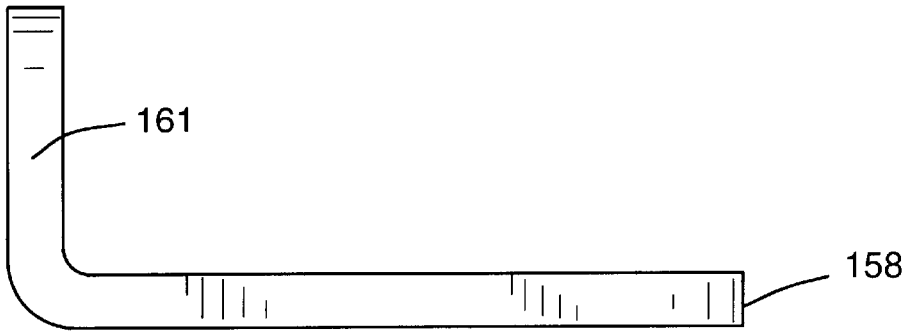
FIG. 30 is a side view of the shelf support of FIG. 28.

FIGS. 28–30 illustrate a shelf support 158 for supporting the front 160 of the shelf 42. At least one shelf support 158 may be fastened to the lock channel 38 and/or the hinge channel 40 by, for example, placing a rivet 150 through the shelf support 158, the rim 140 of the shelf 42 and the lock channel 38 at a point below the shelf 42 such that the rivet 150 is inaccessible through the storage compartment 22. The shelf support 158 may also operate to prevent removal of the shelf 42 by lifting. In the embodiment illustrated in FIGS. 28–30, the shelf support 158 includes a bent portion 161. The bent portion 161 extends through a slot 162 in the shelf 42 and above the shelf 42, thereby preventing the front 160 of the shelf 42 from being lifted.

Figure 6:
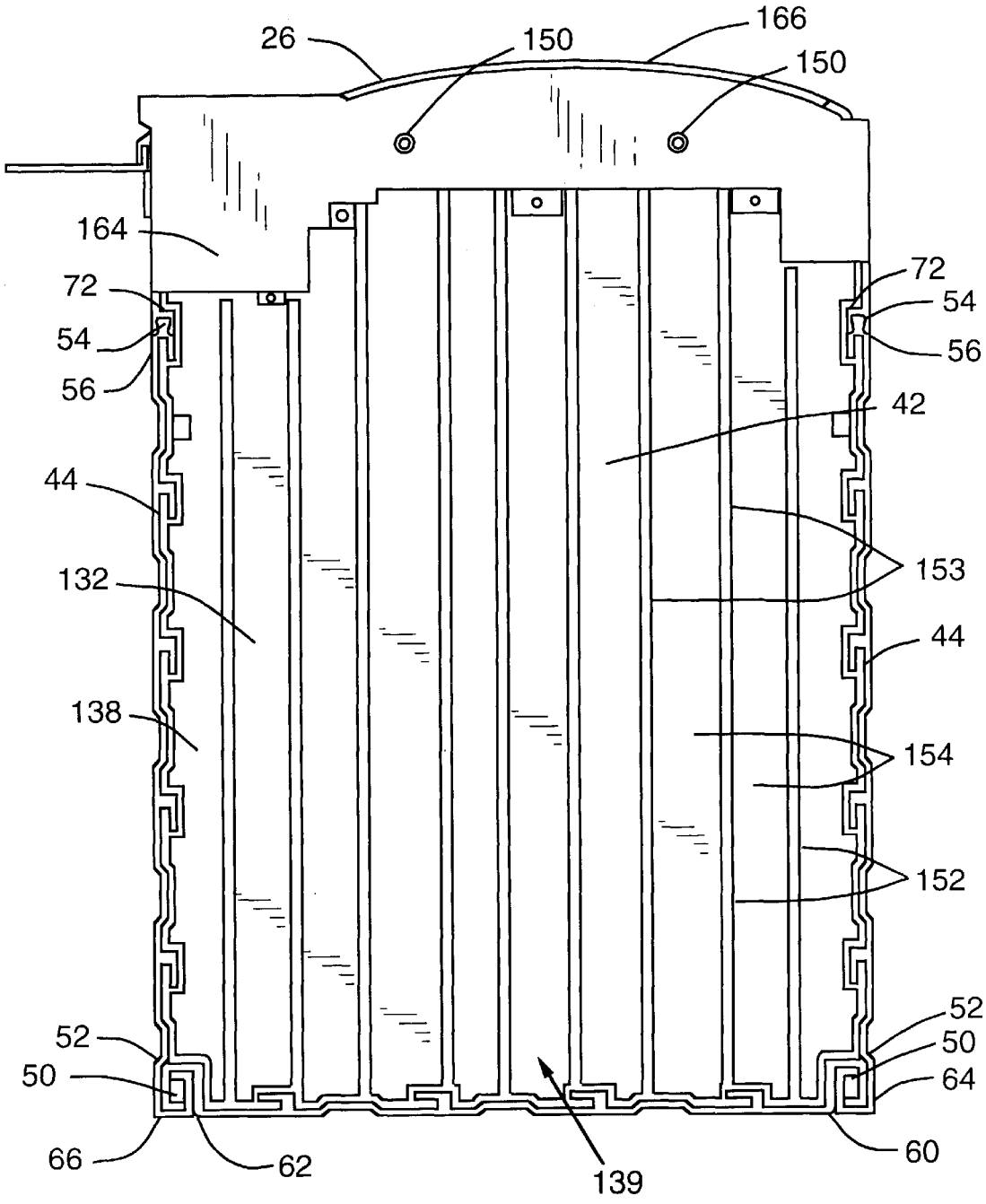
FIG. 6 is an enlarged top view of the locker of FIGS. 1 and 2.
Figure 7:
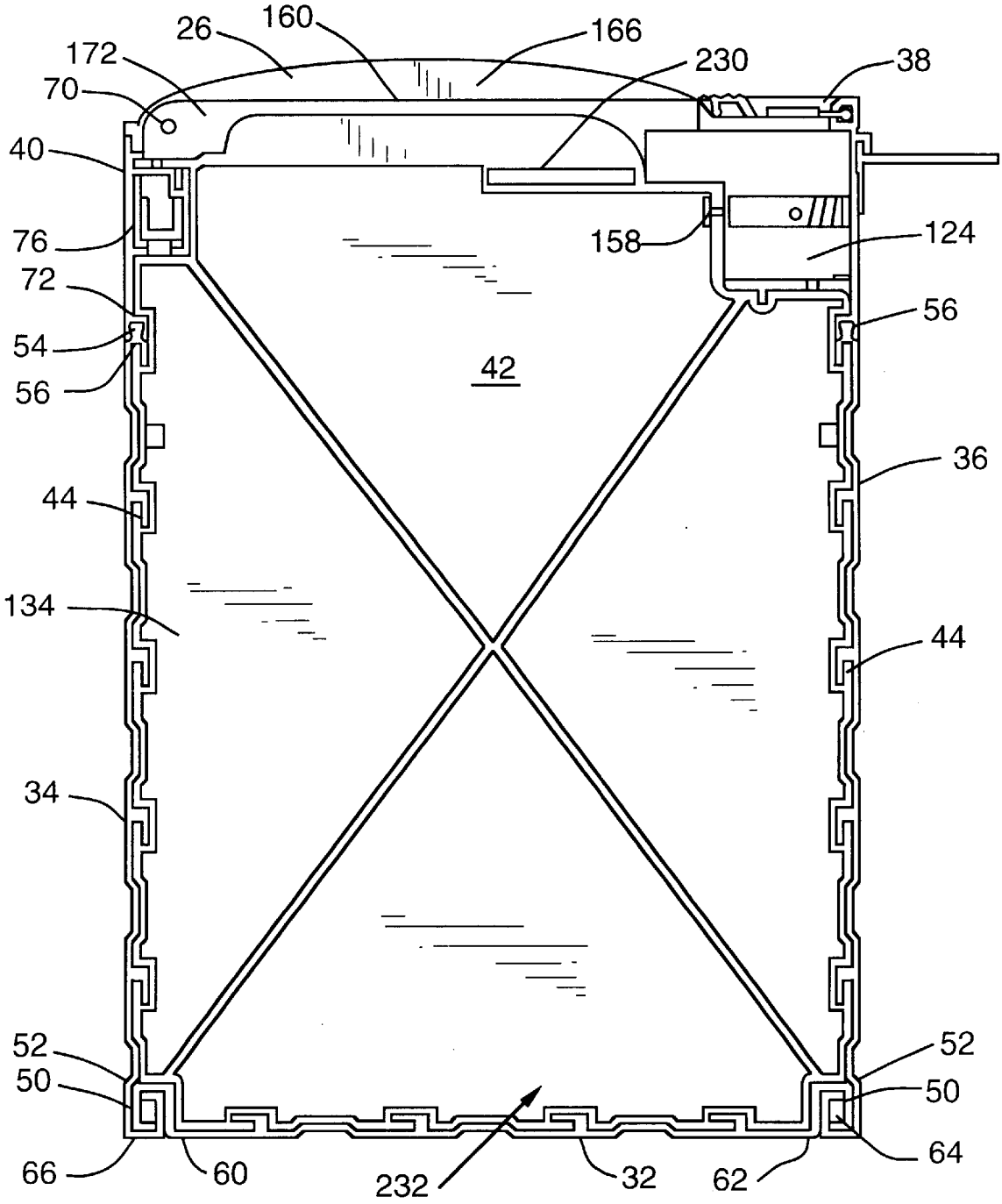
FIG. 7 is an enlarged bottom view of the locker of FIGS. 1 and 2.
Figure 31:
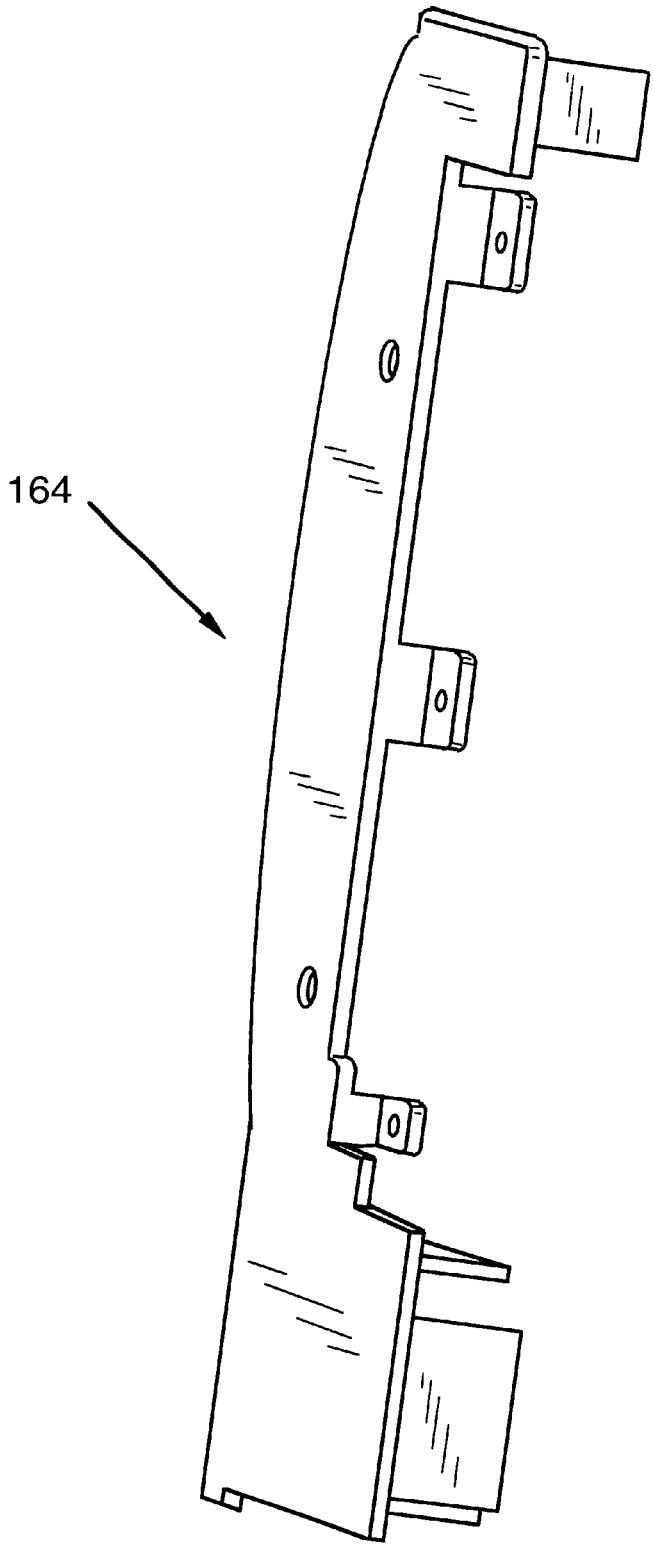
FIG. 31 is a perspective view of a top cap of the present invention.

FIG. 31 is a perspective view of a top cap 164 of the present invention. Where a shelf 42 of the present invention is used as an upper cover 132 for the locker 20, a top cap 164 may be attached over the front of the upper cover 132 to cover the lock channel 38 and the hinge channel 40 as shown in FIG. 6. The top cap 164 may also extend even with the door 26 to prevent access to the rear of the door 26, thereby restricting the ability of a vandal to pry the door 26 open, and to give the locker 20 a finished appearance.

Figure 32:
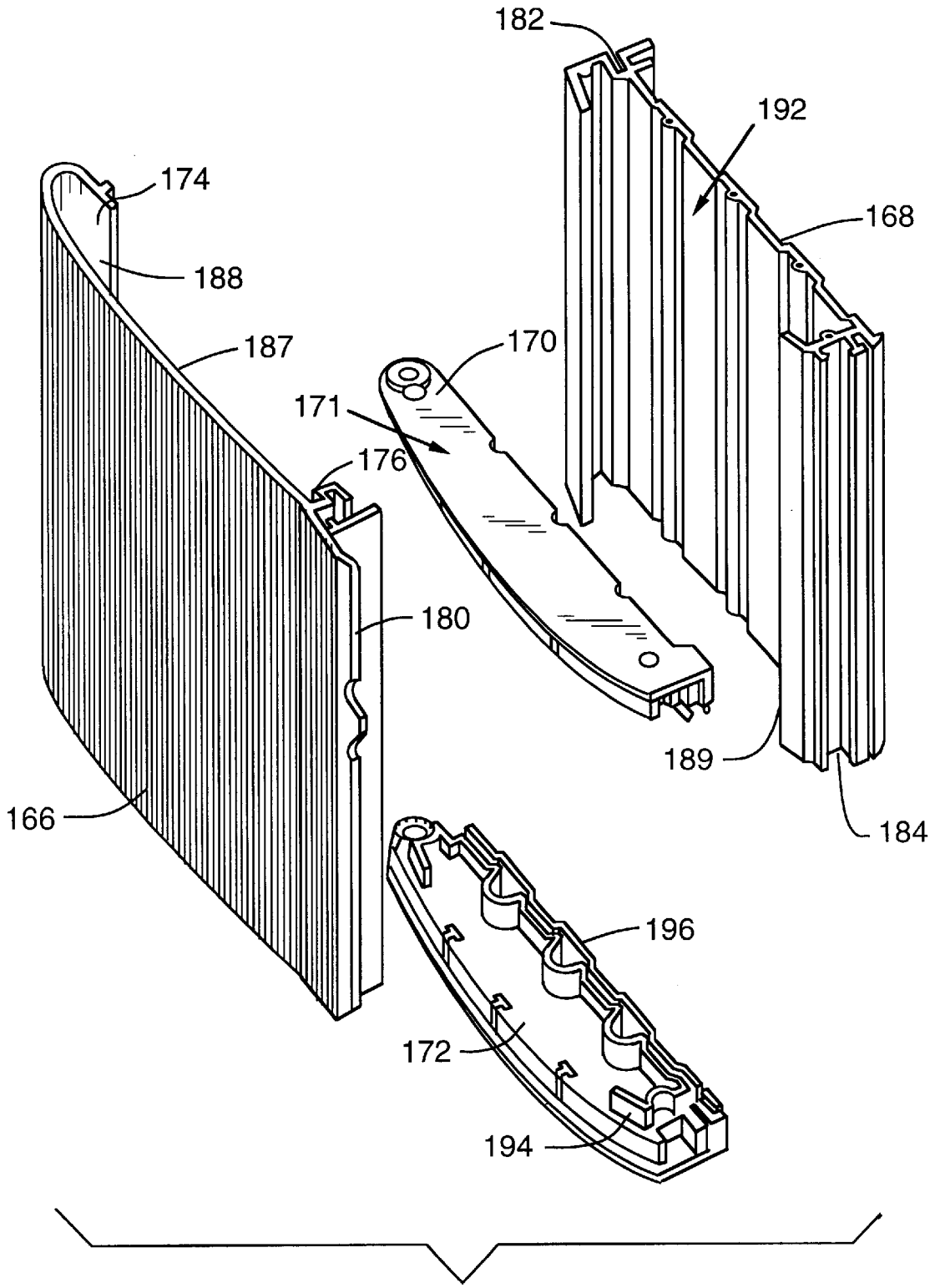
FIG. 32 is an exploded assembly view of a door of the present invention.
Figure 36:
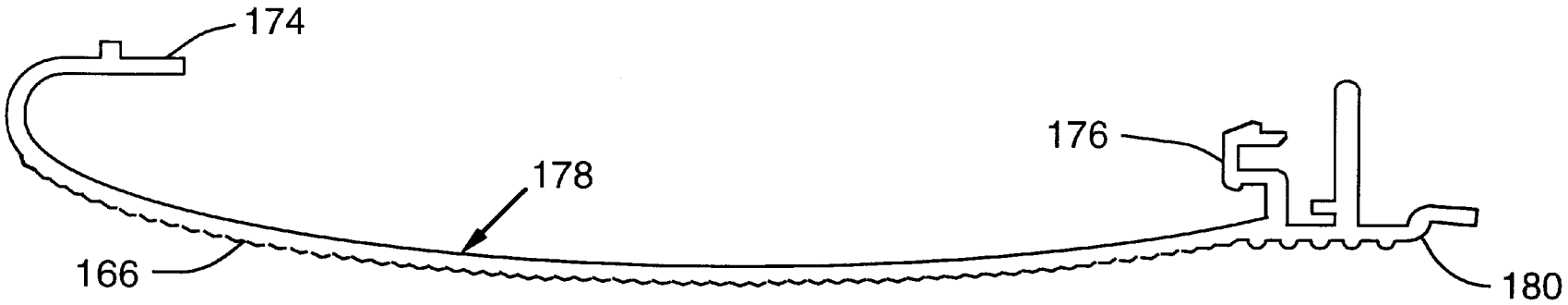
FIG. 36 is a top plan view of a front cover of the door of FIGS. 32 and 33.
Figure 37:
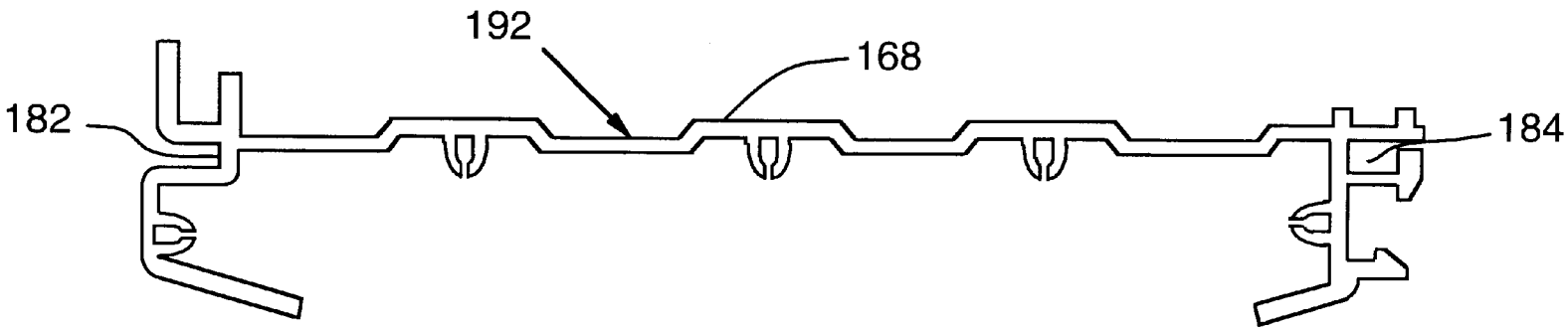
FIG. 37 is a top plan view of a rear member of the door of FIGS. 32, 34 and 35.

FIGS. 32–43 illustrate the door 26 of the locker 20. FIG. 32 is an exploded assembly view of the door 26 shown in perspective. The door 26 includes a front cover 166, a backing member 168, an upper end cap 170 and a lower end cap 172 that is structurally identical to the upper end cap 170. The front cover 166 and backing member 168 may be cut to any desired height so as to flexibly meet a variety of locker size needs. As previously discussed, the left side panel 34, right side panel 36 and rear panel 32 may also be cut to any desired length and the shelves 42 may be place vertically anywhere along the frame 24. Therefore, lockers 20 of the present invention can be built to any desired height with any number of storage compartments 22 of any desired size. The flexibility inherent in such a locker 20 is beneficial in that lockers 20 may be easily manufactured to meet many different needs through the use of common components of the present invention. FIG. 36 is a top view of the front cover 166 and FIG. 37 is a top view of the backing member 168. As may be seen in FIG. 36, the front cover 166 of the door 26 includes an inward turned edge 174 and an opposing T-locking tab 176. The T-locking tab 176 extends from the rear surface 178 of the front cover 166 along the right side 180 of the cover 166 with the tab facing left. The inward turned edge 174 is directed from the left side of the cover 166 toward the T-locking tab 176. As may be seen in FIG. 37, the backing member 168 includes a slot 182 into which the inward turned edge 174 of the front cover 166 extends and a T-locking channel 184 that interlocks with the T-locking tab 176 of the front cover 166.

Figure 33:
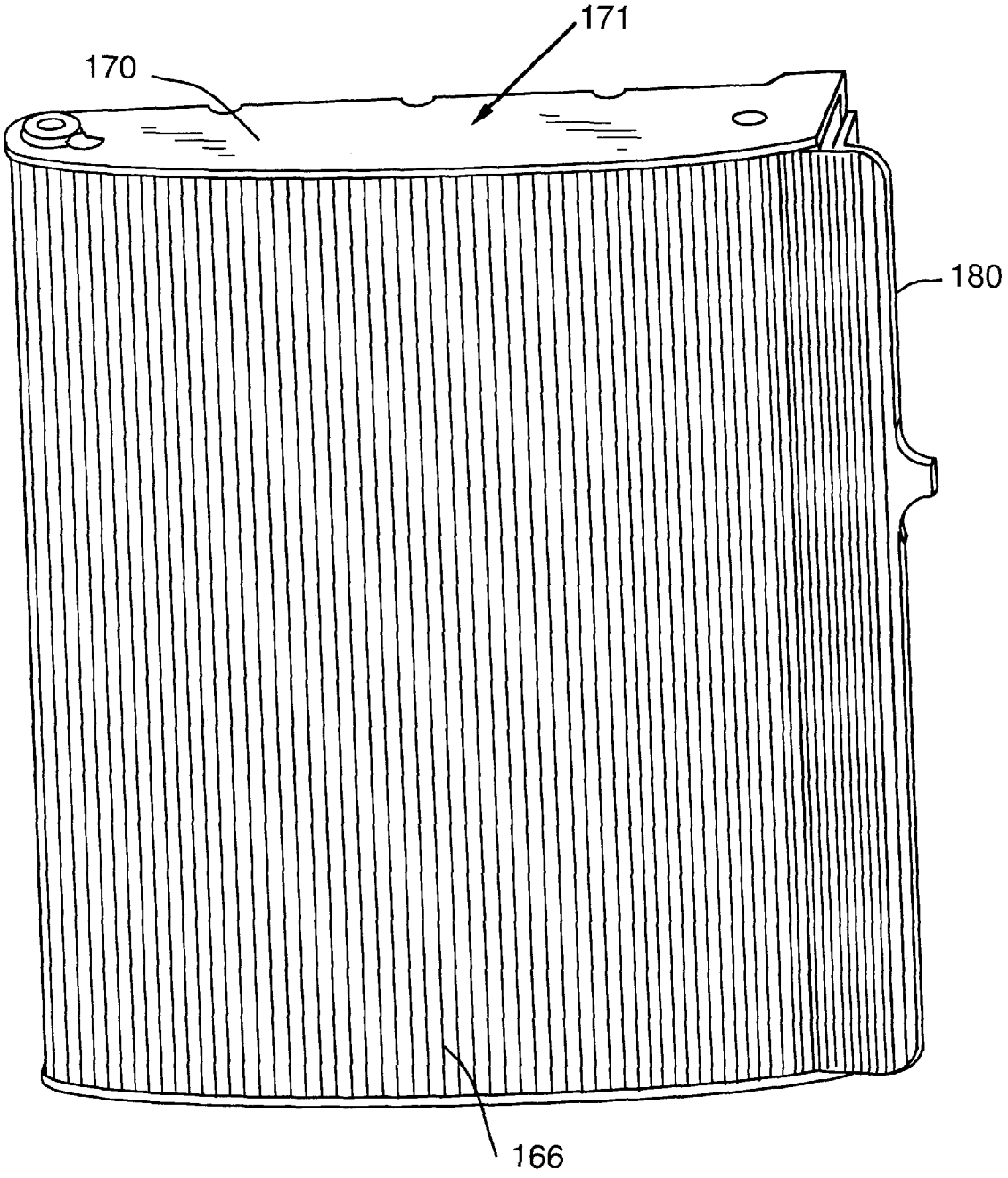
FIG. 33 is a front view of the door of FIG. 32 shown in perspective.
Figure 34:
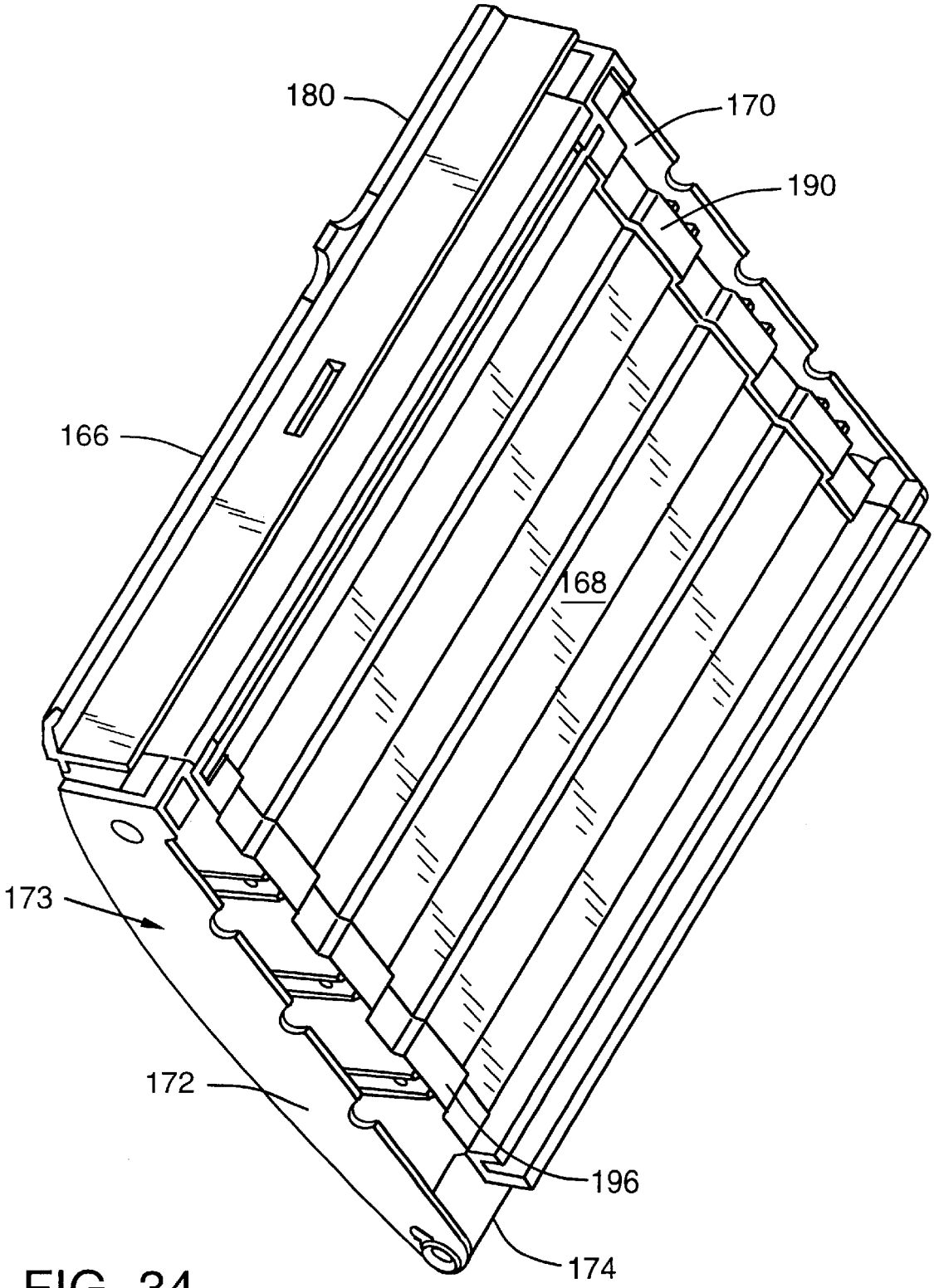
FIG. 34 is a rear view of the door of FIG. 32 shown in perspective.
Figure 35:
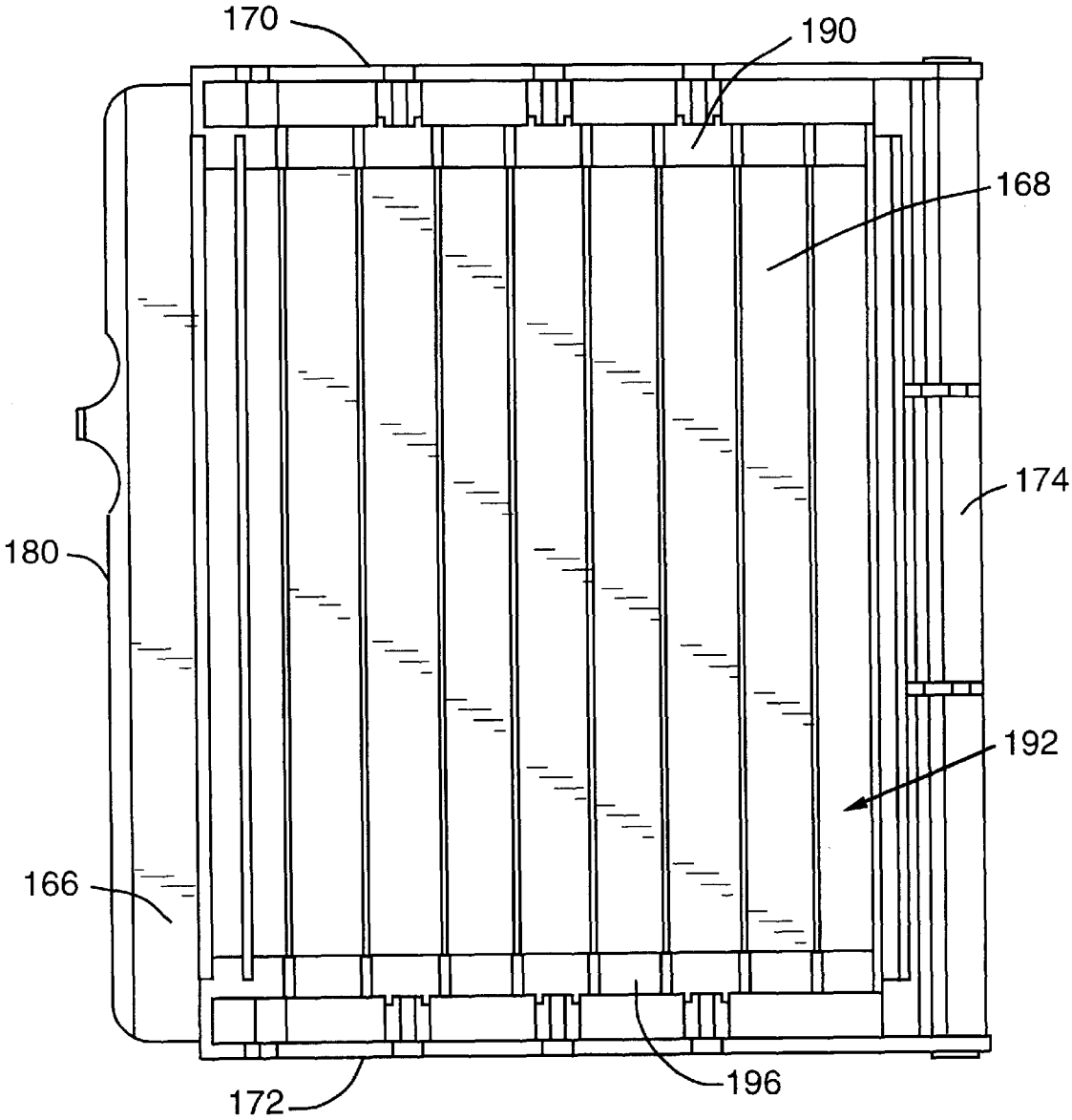
FIG. 35 is a rear elevation view of the door of FIG. 32.
Figure 38:
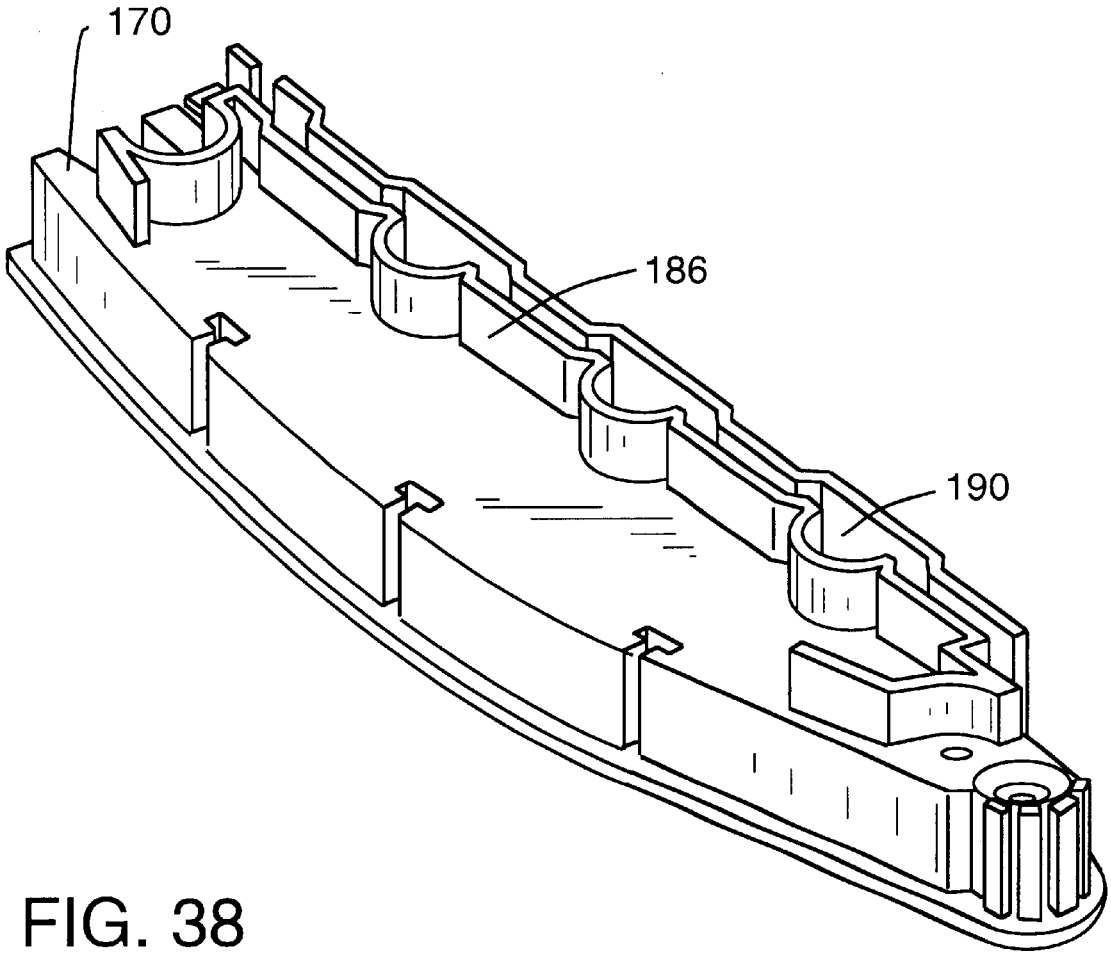
FIG. 38 is a perspective view of the bottom of an upper end cap of the door of FIG. 32.
Figure 39:
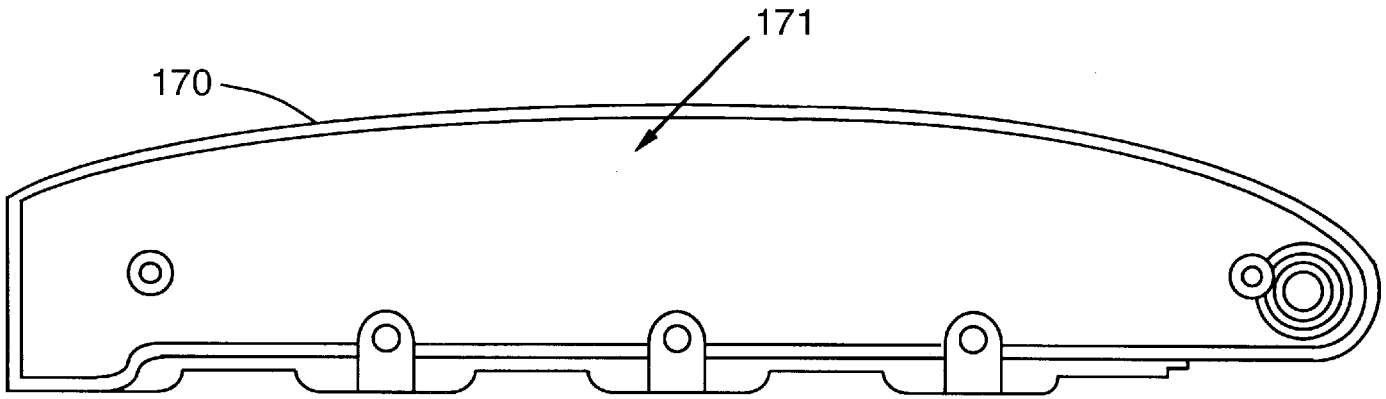
FIG. 39 is a top view of the upper end cap of FIG. 38.
Figure 40:
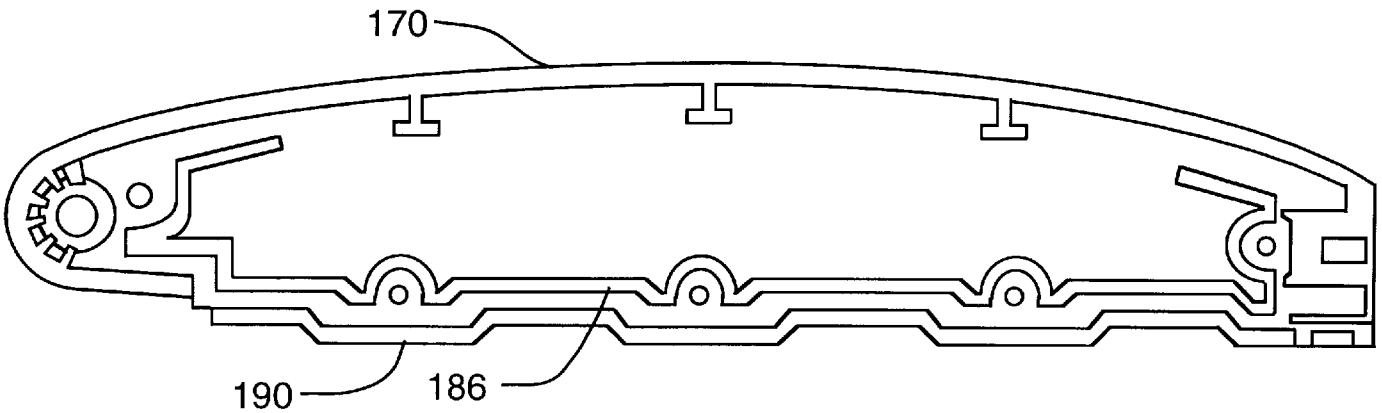
FIG. 40 is a bottom view of the upper end cap of FIG. 38.
Figure 41:
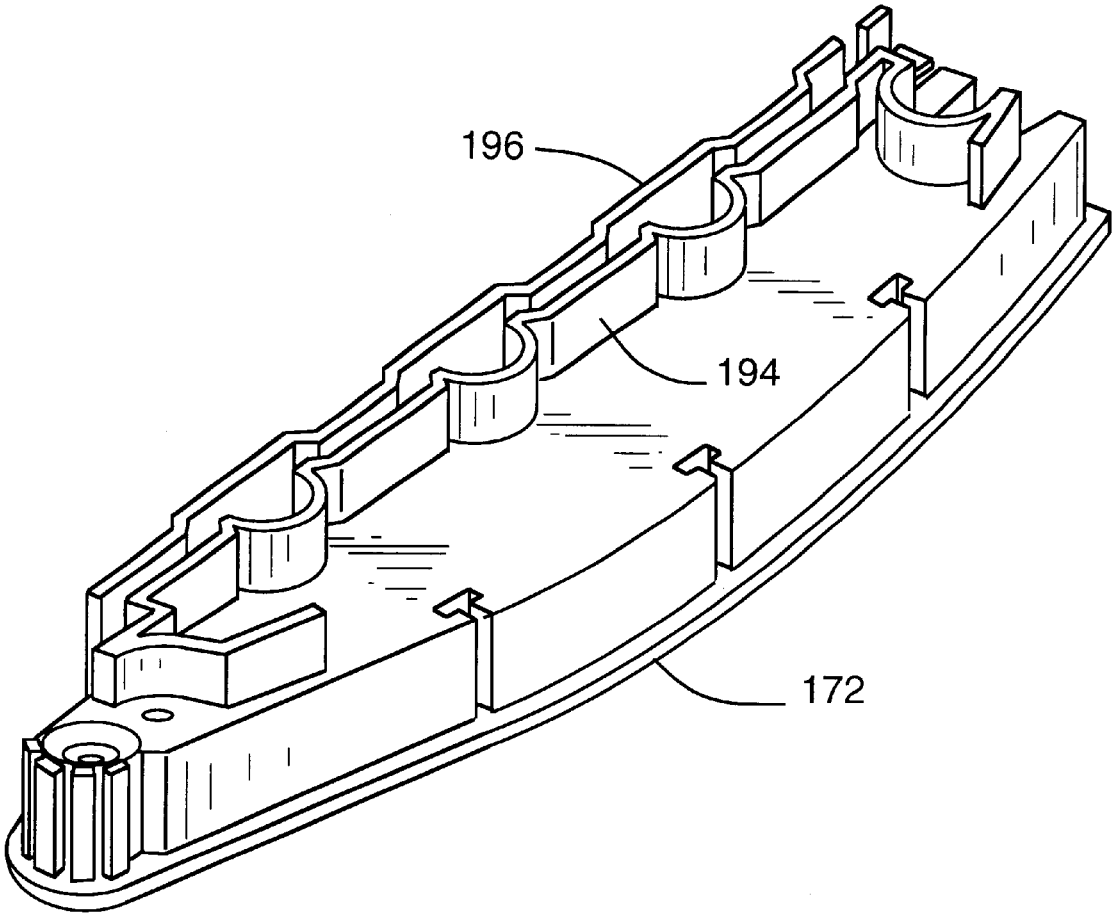
FIG. 41 is a perspective view of the top of a lower end cap of the door of FIG. 32.
Figure 42:
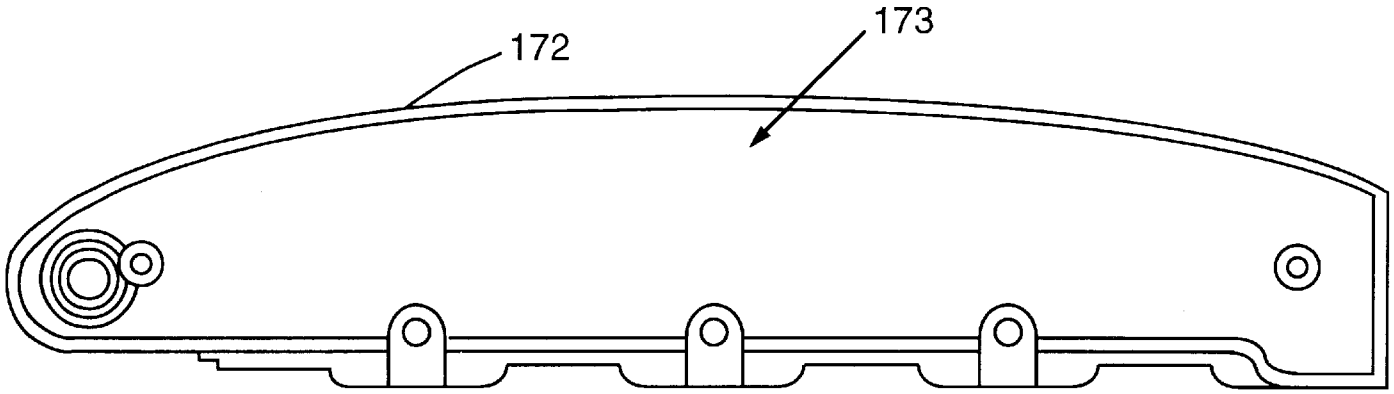
FIG. 42 is a bottom view of the lower end cap of FIG. 41.
Figure 43:
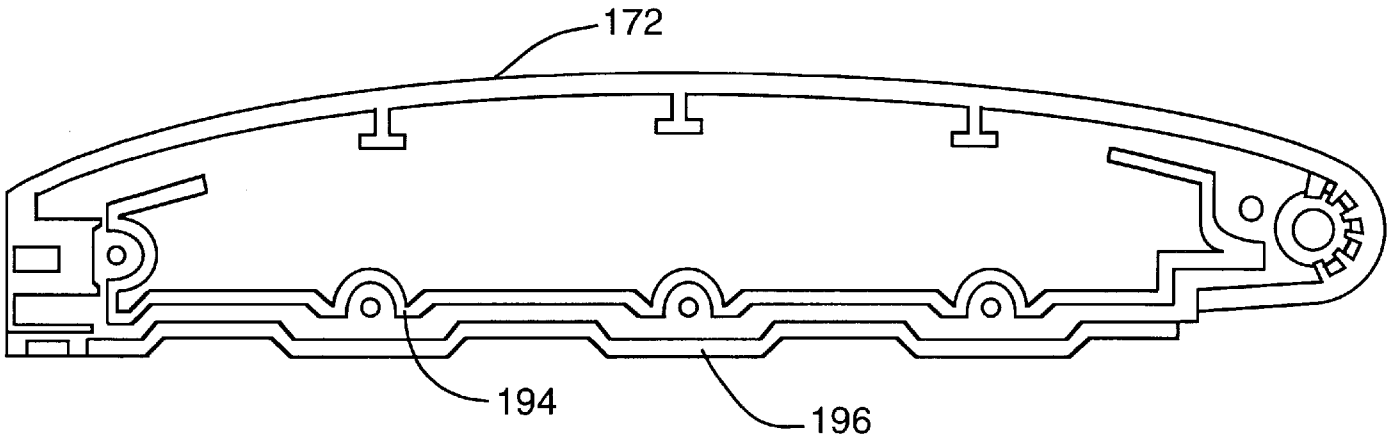
FIG. 43 is a top view of the lower end cap of FIG. 41.

FIG. 38 is a bottom view shown in perspective of the upper end cap 170 of the door 26 of the present invention, and FIGS. 39 and 40 are top and bottom views of the upper end cap 170, respectively. The lower end cap 172 is formed as a mirror image of the upper end cap 170. FIG. 41 is a bottom view shown in perspective of the lower end cap 172 and FIGS. 42 and 43 are top and bottom views of the lower end cap 172, respectively. The assembly of the upper and lower end caps 170 and 172 to the front cover 166 and backing member 168 are also illustrated in FIGS. 32–34. The end caps 170 and 172 secure the front cover 166 to the backing member 168 and provide the door 26 with finished upper and lower surfaces 171 and 173, respectively. As depicted on FIG. 32, a first ridge 186 (shown on FIG. 38) of the upper end cap 170 fits within the gap 188 formed between the front cover 166 and backing member 168. A second ridge 190 also extends from the upper end cap 170. The second ridge 190 extends along the rear surface 192 of the backing member 168 when engaged therewith. Once the front cover 166 and backing member 168 have been cut to a desired length, the first ridge 186 of the upper end cap 170 is inserted into the upper end 187 of the gap 188 formed between the front cover 166 and backing member 168 with the second ridge 190 of the upper end cap 170 disposed along the rear surface 192 of the backing member 168. The upper end cap 170 is fastened to the front cover 166 and backing member 168 by any known means including placing screws (not shown) through the upper end cap 170 into the front cover 166 and/or backing member 168. Similarly, the first ridge 194 of the lower end cap 172 is inserted into the lower end 189 of the gap 188 formed between the front cover 166 and backing member 168. The second ridge 196 of the lower end cap 172 is disposed along the rear surface 192 of the backing member 168 and the lower end cap 172 is fastened to the front cover 166 and backing member 168. The doors of conventional lockers are susceptible to being damaged by vandals or otherwise. Therefore, it is a benefit of the present invention that the front cover 166 can be easily replaced without necessitating replacement of the entire door 26.

The door 26 is attached to a commonly known hinge rod 70 which may be fabricated from, for example, aluminum or stainless steel. Where a locker 20 is to include multiple doors 26 stacked one above another with shelves separating each compartment 22, a single hinge rod 70 may extend through the assembly such that each door 26 swings on the common hinge rod 70. The hinge rod 70 may also extend through the shelves of the locker 20, thereby securing the doors 26 to the frame 24. It is also beneficial to utilize a torsion spring (not shown) in conjunction with each door 26. The torsion spring beneficially biases the door 26 toward its closed position so that all doors 26 are closed unless held open by a user.

Figure 44:
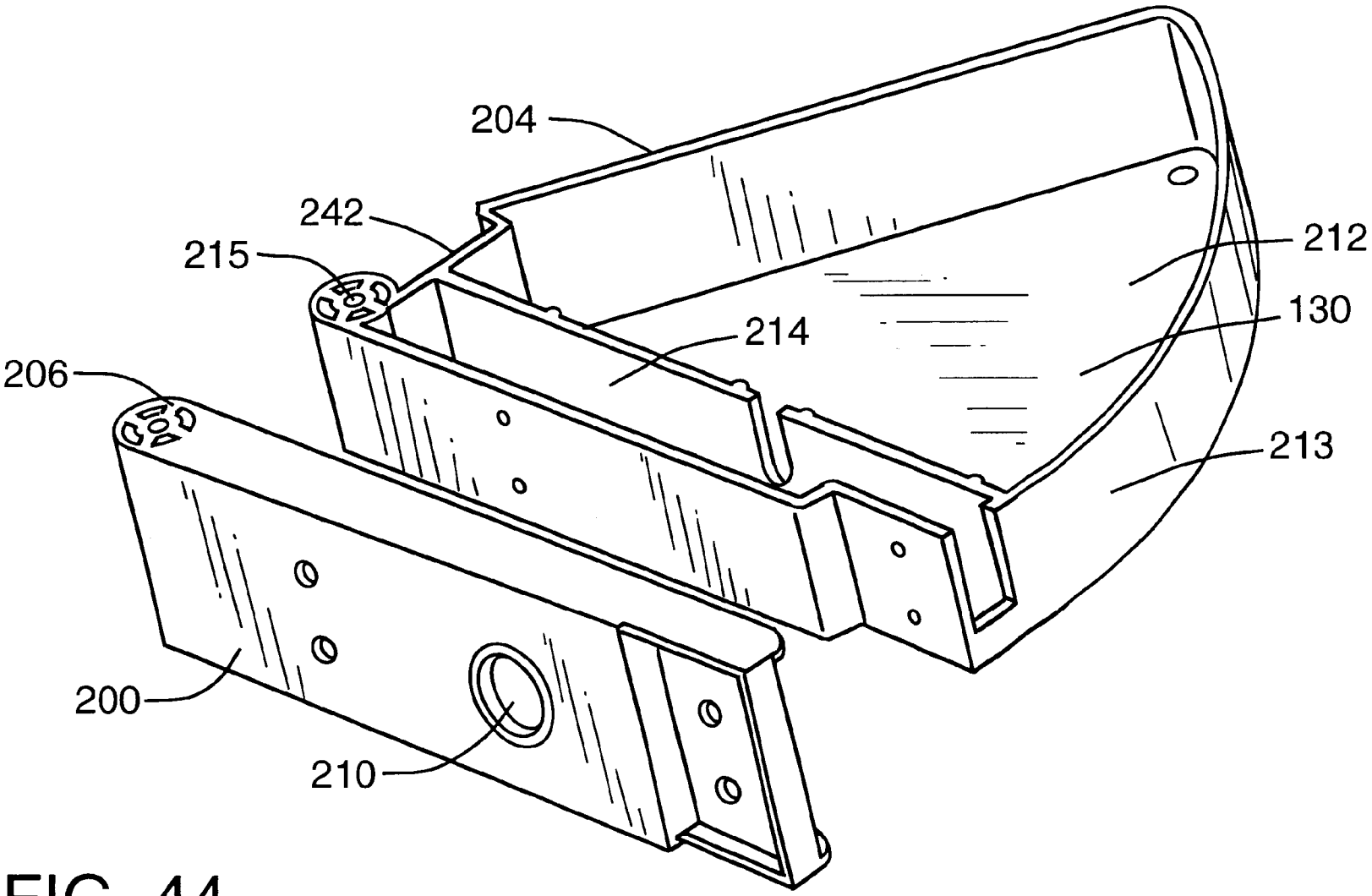
FIG. 44 is an exploded assembly view of a coin receptacle of the present invention.
Figure 45:
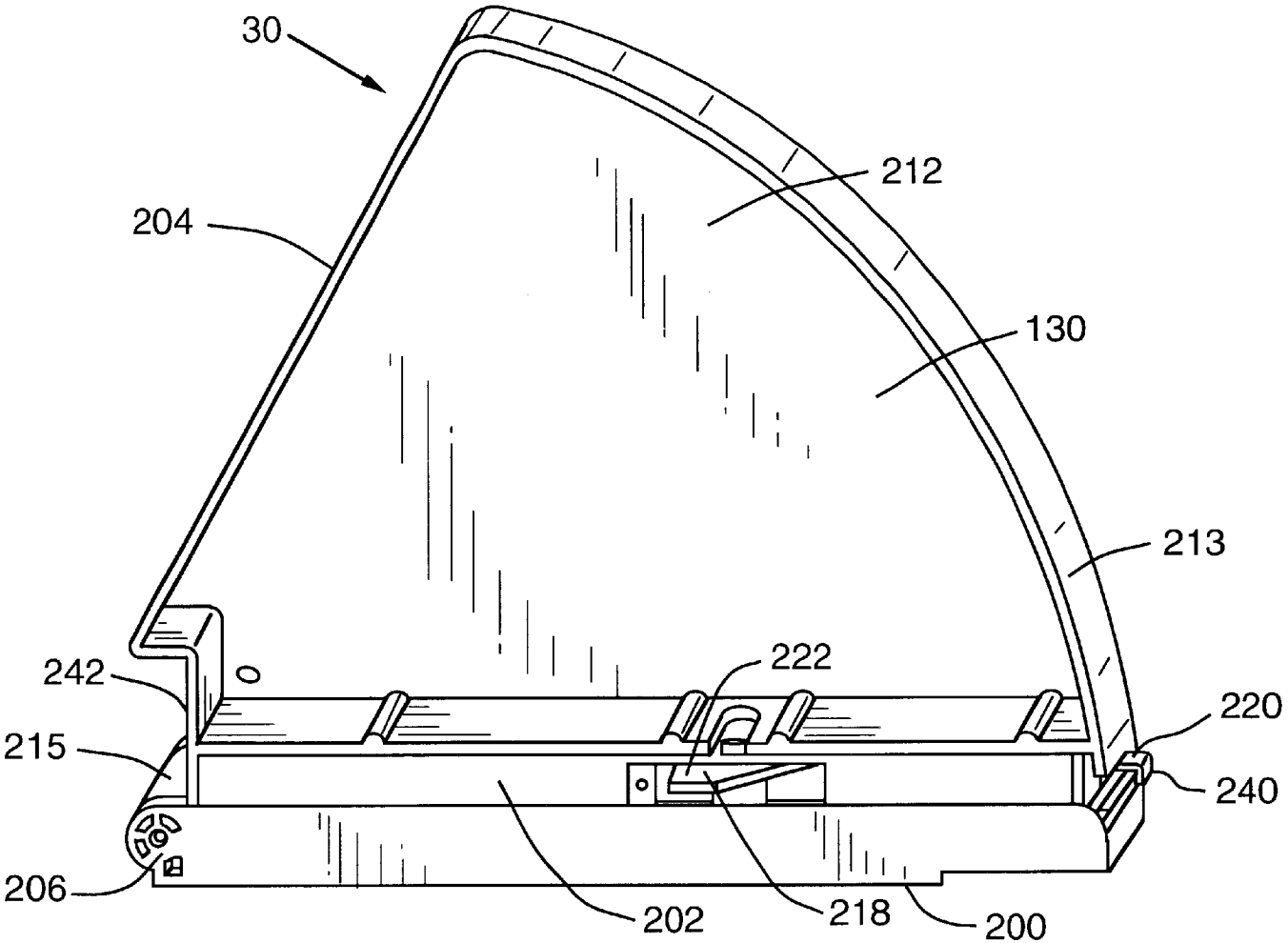
FIG. 45 is a top view of the coin receptacle of FIG. 44 shown in perspective.
Figure 46:
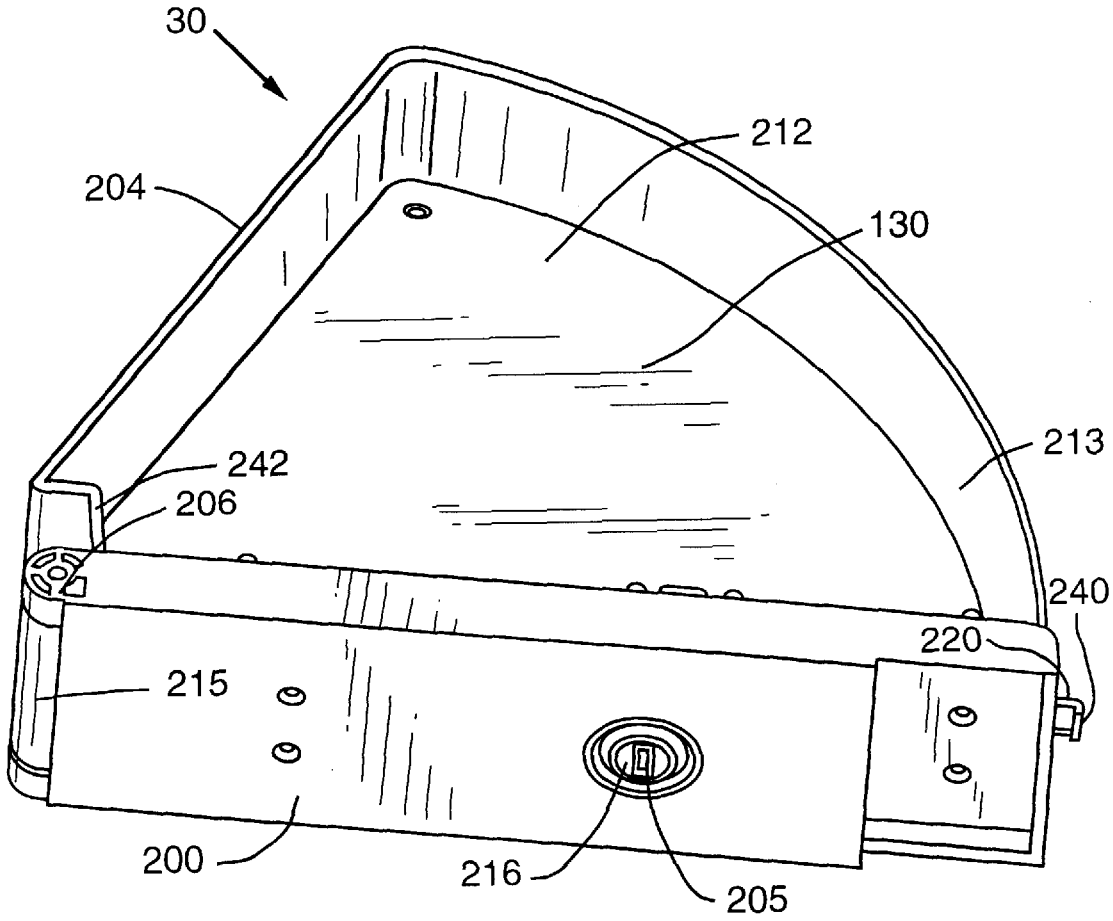
FIG. 46 is another top view of the coin receptacle of FIG. 44 shown in perspective.
Figure 47:
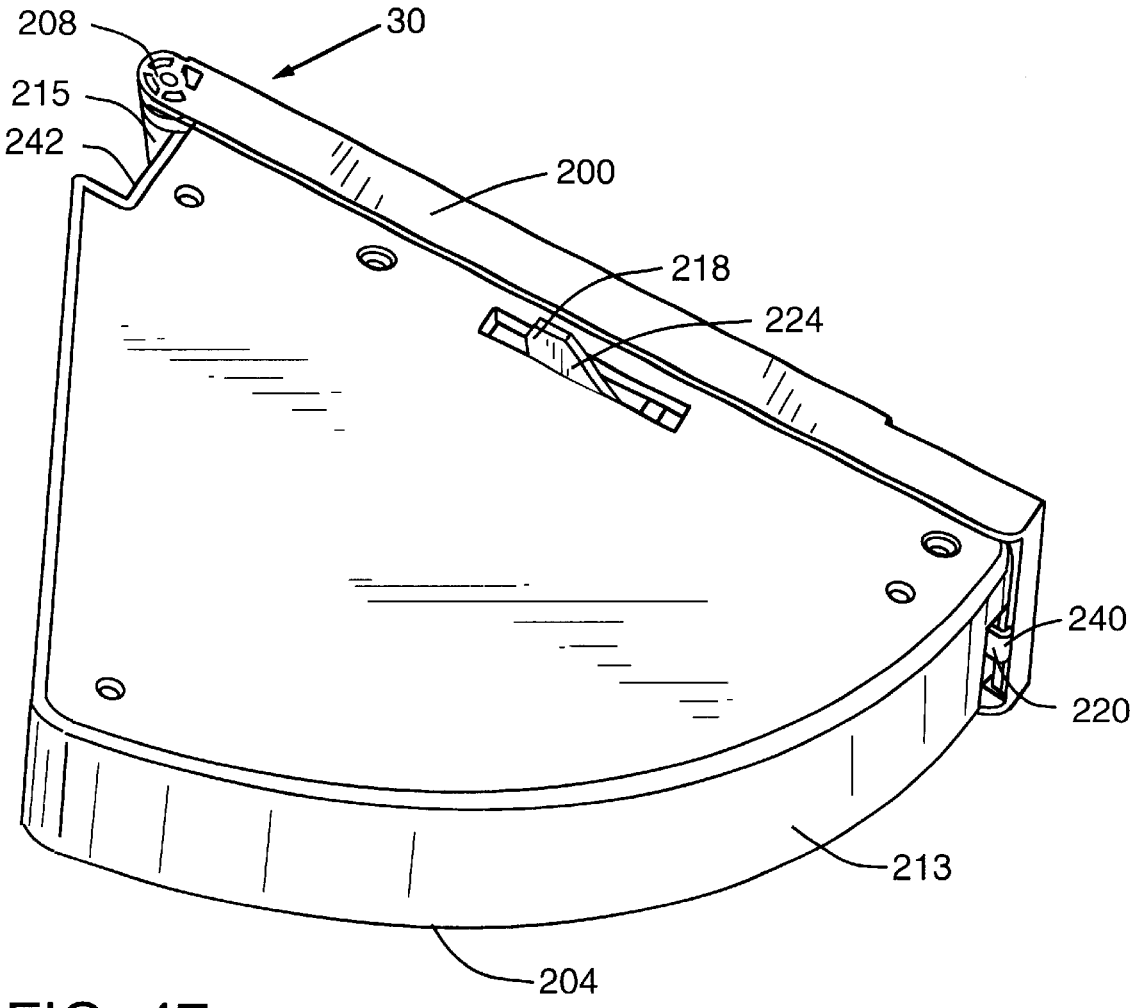
FIG. 47 is a bottom view of the coin receptacle of FIG. 44 shown in perspective.

FIGS. 44–54 depict the coin receptacle 30 which, in the embodiment illustrated, also pivots on the common hinge rod 70 which is illustrated in FIG. 2. The coin receptacle 30 includes a face member 200, a three-point coin tray lock 202, and a fixed tray 204. FIG. 44 is an exploded assembly view of the face member 200 and the fixed tray 204. The face member 200 and fixed tray 204 may be fabricated from the same material as the frame 24 and may be, for example, plastic. The face member 200 may be attached to the fixed tray 204 by a known method including, for example, riveting the face member 200 and fixed tray 204 together. The face member 200 includes an upper ear 206 and a lower ear 208 through which the hinge rod 70 is disposed and the face member 200 may extend across the entire width of the locker 20. The face member 200 may furthermore include a hole 210 through which the barrel 216 of the coin tray lock 202 may extend. The fixed tray 204 may include a coin holding compartment 212, a locking mechanism compartment 214, and a hinge rod receptacle 215 that fits between the upper ear 206 and lower ear 208 of the face member 200. As may be seen in FIGS. 16 and 17, a portion of the lock channel 38 may be cut away to permit the fixed tray 204 to extend under the lock channel 38 to accommodate the passage of coins passing from the storage compartment locking mechanism 28 to the coin holding compartment 212. By extending the coin receptacle 30 thus, the coins simply drop into the receptacle 30 after passing through the storage compartment locking mechanism 28. The right side 213 of the coin receptacle 30 is arcuate to permit the fixed tray 204 to rotate on the hinge rod 70 without contacting the right side panel 36 of the locker 20. A removable tray (not shown) may be placed in the fixed tray 204 of the coin receptacle 30. Use of the removable tray will simplify removal of coins from the fixed tray 204 by utilizing a method of coin removal comprising removing the removable tray, pouring the contents into a collection bin (not shown) and reinserting the removable tray in the fixed tray 204.

Figure 48:
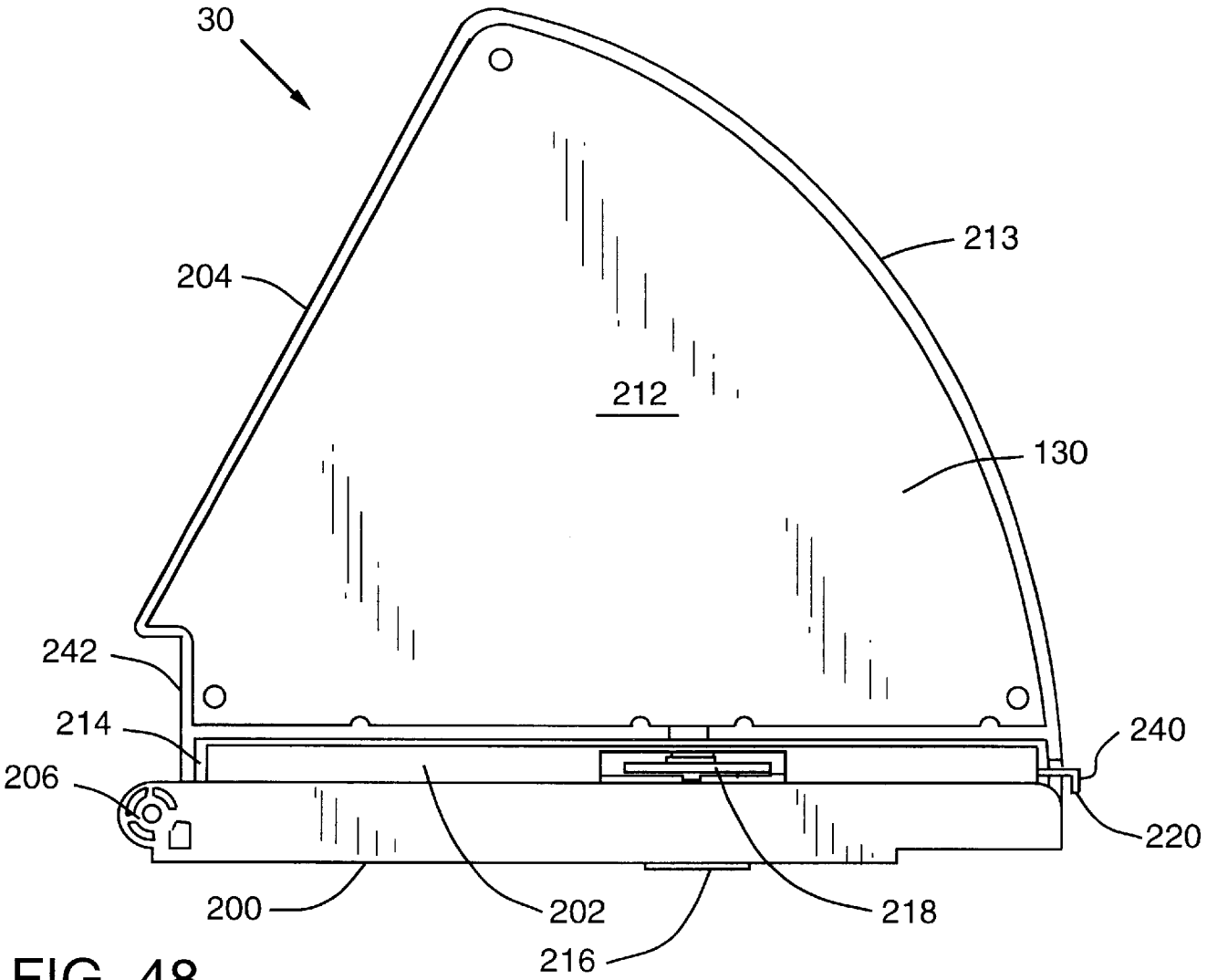
FIG. 48 is a top view of the coin receptacle of FIG. 44.
Figure 49:
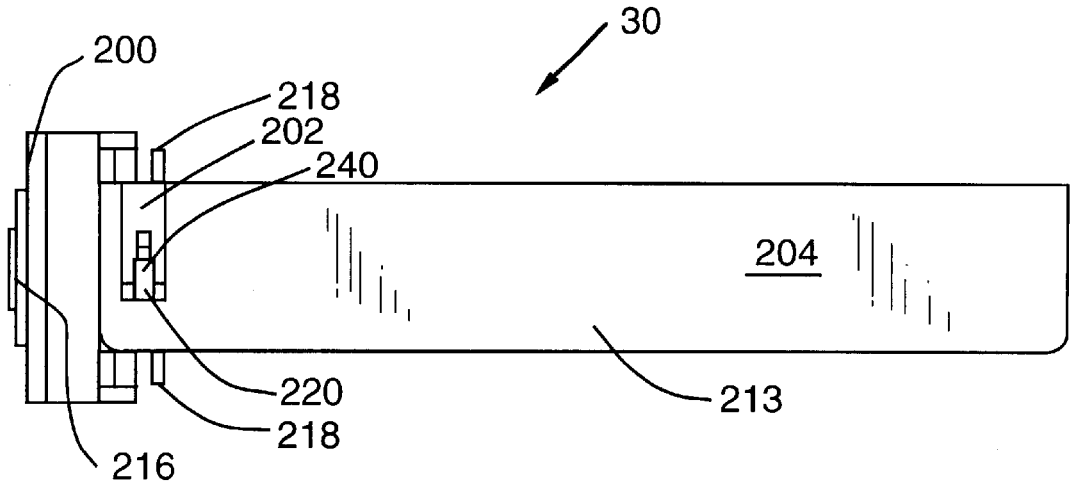
FIG. 49 is a side elevational view of the coin receptacle of FIG. 44.
Figure 50:
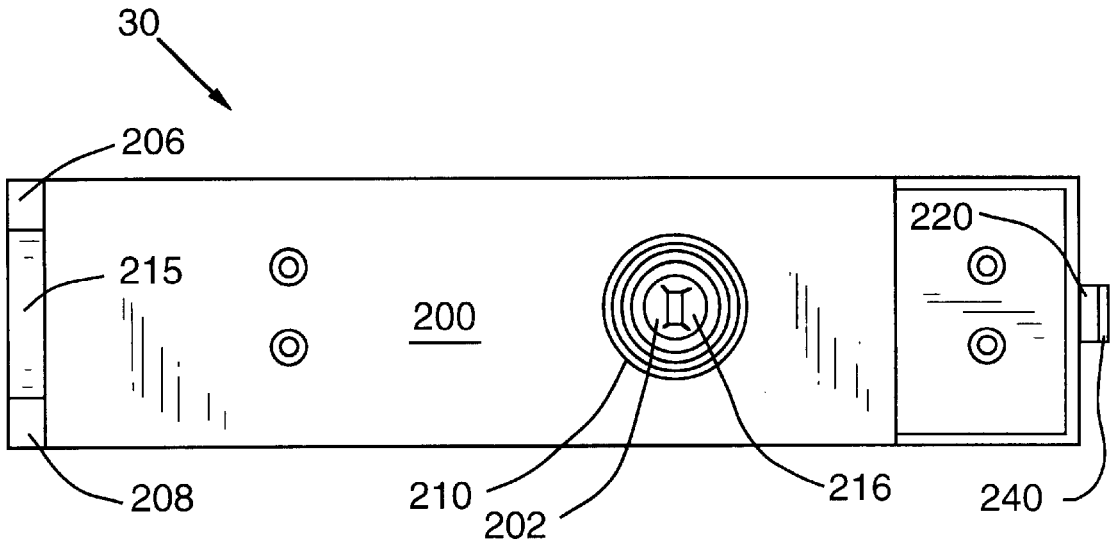
FIG. 50 is a front elevational view of the coin receptacle of FIG. 44.
Figure 51:
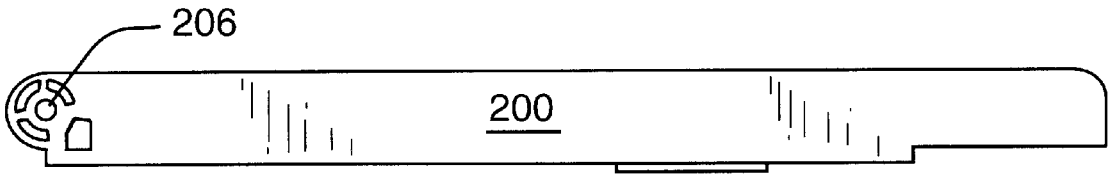
FIG. 51 is a top view of a face member of the coin receptacle of FIG. 44 and 46–50.
Figure 52:
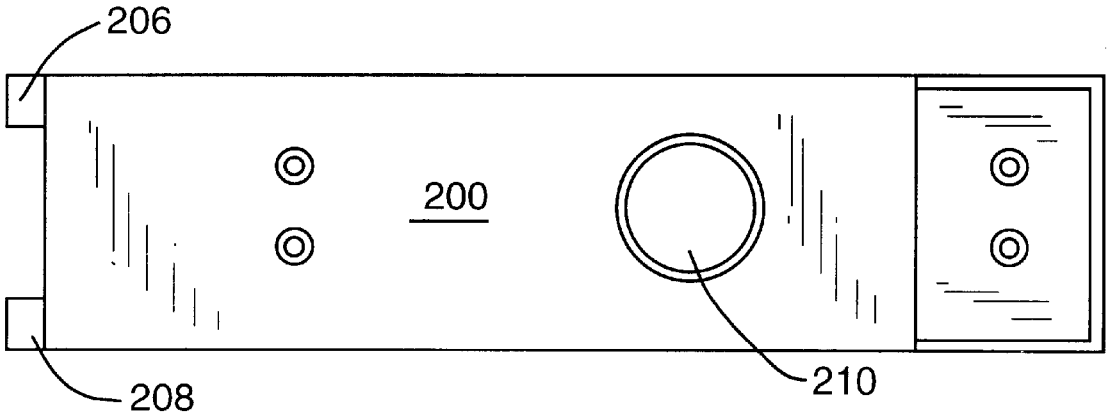
FIG. 52 is a front elevational view of the face member of FIG. 51.
Figure 53:
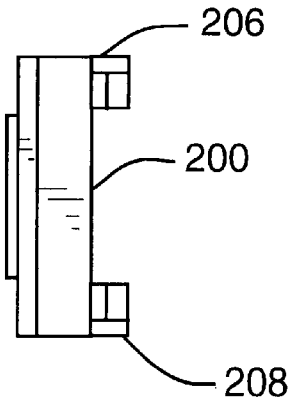
FIG. 53 is a right side elevational view of the face member of FIG. 51.
Figure 54:
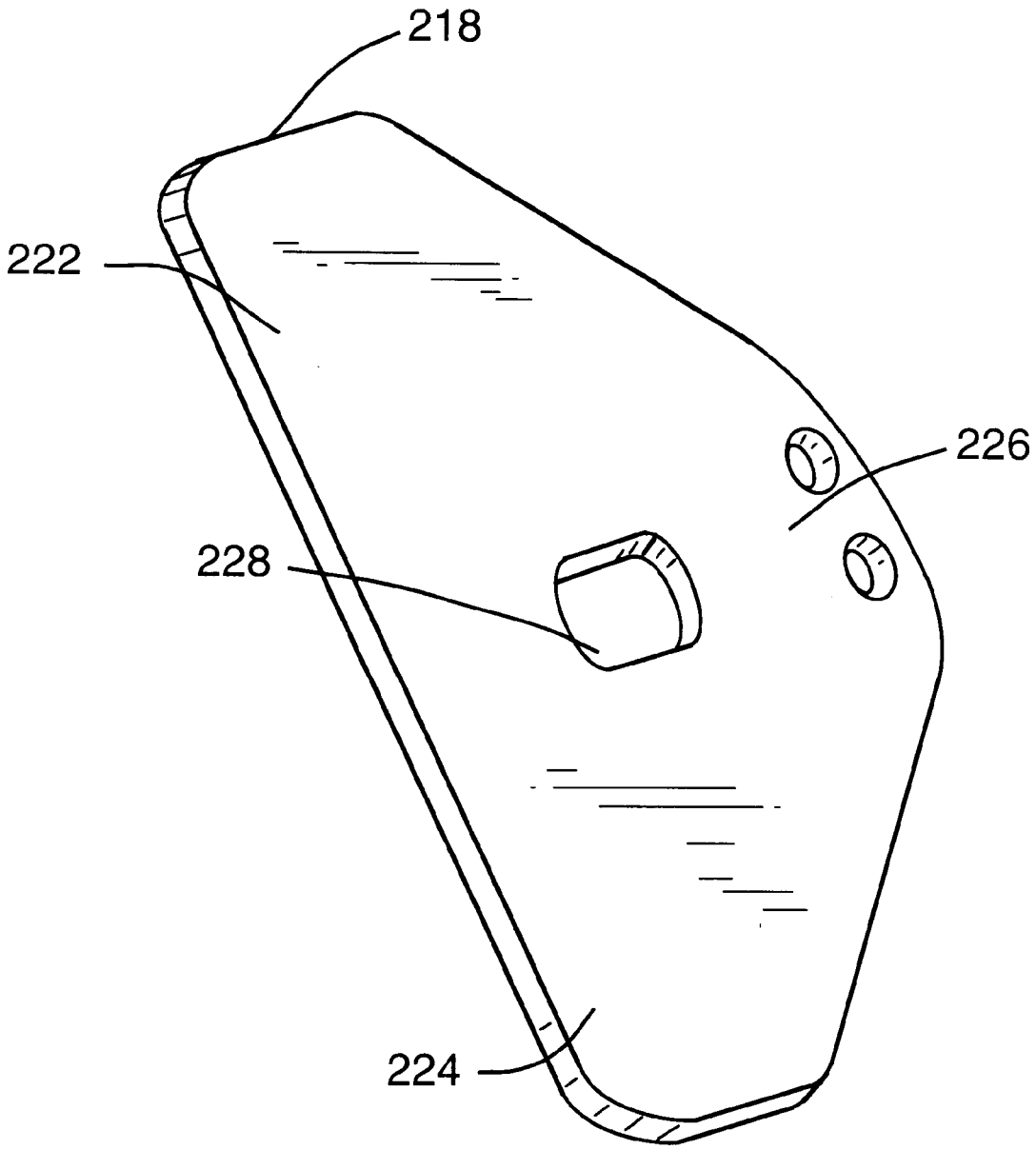
FIG. 54 is a perspective view of a locking cam of the present invention.

In the embodiment illustrated in FIG. 44, the three-point coin tray lock 202 is inserted into the lock compartment of the fixed tray 204. The three-point coin tray lock 202 includes a barrel 216 that extends through the face member, a cam 218 and a lock bar 220. The barrel 216 accepts a key (not shown) which locks and unlocks the three-point coin tray locking mechanism 202 when rotated. The locking cam 218 has an upper lobe 222, a lower lobe 224 and a lock bar connecting lobe 226. The locking cam 218 is attached to the barrel 216 of the lock through a centrally located opening 228 in the cam 218 such that the lobe rotates when the barrel 216 is rotated by the key. When the locking cam 218 is rotated to its locked position, the upper lobe 222 extends into a slot 230 defined in the bottom 232 of the shelf 42 that is placed above the coin receptacle 30 and the lower lobe 224 extends into a slot 234 defined in the top 236 of the shelf 42 that is placed below the coin receptacle 30. See FIGS. 25 and 26 to view the slots 230 and 234 in the bottom 232 and top 236 of the shelf 42, respectively. The lock bar 220 is pivotally attached to the lock bar connecting lobe 226 such that the lock bar 220 extends into the frame 24 or an opening 238 in a member such as, for example, the deflector 126 as depicted in FIGS. 16 and 17 when the locking cam 218 is rotated to its locked position. The lock bar 220 may furthermore have a hooked end 240 that will extend along the deflector 126 when placed in the locked position to further secure the lock bar 220 therein. The fixed tray 204 may also include a notch 242 as illustrated in FIG. 48 that engages the frame 24 when the coin receptacle 30 is closed, thereby further securing the coin receptacle 30 when the coin receptacle 30 is closed and locked.

A method is also provided for protecting goods placed on a surface from liquid that is deposited on the surface. The method includes draining the liquid from the surface by providing sloped channels 154 in the surface, and placing the goods on upstanding ribs 152 disposed between the channels 154.

Thus, from the foregoing discussion, it is apparent that the present locker 20 solves many of the problems encountered by prior lockers.

Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A locker, comprising:

a first side wall having a first interlocking portion and a second interlocking portion;

a second side wall having a first interlocking portion slidably engaging said first interlocking portion of said first side wall and a second interlocking portion;

a third side wall having a first interlocking portion slidably engaging said second interlocking portion of said second side wall; and a hinge channel having an interlocking portion slidably engaging said second interlocking portion of the first wall, and wherein:

the second interlocking portion of the first wall includes a locking tab that is slidably received into a locking channel formed along one edge of the hinge channel; and the hinge channel includes a hinge-component receiving section.

2. The locker of claim 1, wherein the locking tab and the locking channel are T-shaped.

3. The locker of claim 1, wherein the hinge-component receiving section is U-shaped.

4. The locker of claim 1 wherein at least one of said side walls is corrugated.

5. The locker of claim 1, wherein at least two of said side walls are cut from the same stock.

6. A locker, comprising:

a first side wall having a first interlocking portion and a second interlocking portion;

a second side wall having a first interlocking portion slidably engaging said first interlocking portion of said first side wall and a second interlocking portion;

a third side wall having a first interlocking portion slidably engaging said second interlocking portion of said second side wall;

a hinge channel having an interlocking portion slidably engaging said second interlocking portion of the first wall;

a lock member having an interlocking portion slidably engaging a second interlocking portion of the third side wall; and a reinforcement channel received into the lock member.

7. The locker of claim 6, wherein the second interlocking portion of the third side wall includes a locking tab that is slidably received into a locking channel formed along one edge of a first section of the lock member.

8. The locker of claim 7, wherein the locking tab and the locking channel are T-shaped.

9. The locker of claim 6, wherein the lock member is sized to receive a locking mechanism.

10. The locker of claim 9, wherein the lock member includes a second section shaped for receiving a locking mechanism.

11. The locker of claim 10, wherein the first section of the lock member includes at least one channel that slidably receives a bead formed on the second section of the lock member.

* * * * *